US006872105B2

(12) United States Patent
Dusablon et al.

(10) Patent No.: US 6,872,105 B2
(45) Date of Patent: Mar. 29, 2005

(54) WATERCRAFT HAVING A JET PROPULSION SYSTEM WITH IMPROVED EFFICIENCY

(75) Inventors: Patrice Dusablon, Palm Bay, FL (US); Gilles Pesant, Palm Bay, FL (US); Bhaskar Marathe, Wooster, OH (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/411,190

(22) Filed: Apr. 11, 2003

(65) Prior Publication Data

US 2003/0194924 A1 Oct. 16, 2003

Related U.S. Application Data

(60) Provisional application No. 60/371,497, filed on Apr. 11, 2002.

(51) Int. Cl.[7] ..... B63H 21/22
(52) U.S. Cl. ..... 440/1; 440/38; 440/47
(58) Field of Search ..... 440/1, 2, 38, 47; 114/287

(56) References Cited

U.S. PATENT DOCUMENTS 3,413,948 A * 12/1968 Coll ..... 114/287
3,942,463 A 3/1976 Johnson, Jr. et al.
4,231,315 A 11/1980 Tachibana et al.
4,373,919 A 2/1983 Stangeland
4,449,944 A 5/1984 Baker et al.
4,775,341 A 10/1988 Tyler et al.
5,199,913 A 4/1993 Toyohara et al.
5,324,216 A 6/1994 Toyohara et al.
5,401,198 A 3/1995 Toyohara et al.
5,658,176 A 8/1997 Jordan
5,910,033 A 6/1999 Norrstrand
5,989,083 A 11/1999 Ishigaki et al.
6,315,624 B1 * 11/2001 Tetzlaff et al. ..... 440/89 R
6,375,523 B1 4/2002 Mathias

* cited by examiner

*Primary Examiner*—Stephen Avila
(74) *Attorney, Agent, or Firm*—BRP Legal Services

(57) ABSTRACT

A watercraft, equipped with a jet propulsion system with improved efficiency of operation is disclosed. Structures are disposed within a water passage of the jet propulsion system at a position upstream of the jet propulsion unit that modulate the amount of water that is allowed to pass through the water passage. The structures can be a flexible fluid filled bag, an adjustable ride plate, and an additional water passage. Each of the structures allow a greater amount of water into the water passage during acceleration than during constant speed travel of the watercraft.

31 Claims, 18 Drawing Sheets

WATERCRAFT HAVING A JET PROPULSION SYSTEM WITH IMPROVED EFFICIENCY

This application relies for priority on U.S. Provisional Patent Application Ser. No. 60/371,497, filed on Apr. 11, 2002, entitled "WATERCRAFT HAVING A JET PROPULSION SYSTEM WITH IMPROVED EFFICIENCY." The contents of that provisional patent application are incorporated herein by reference.

BACKGROUND OF THE INVENTION

1. Field of the Invention

This invention relates to jet powered watercraft, especially personal watercraft ("PWC"). More specifically, the invention concerns the jet propulsion system of the watercraft. In particular, the invention is directed to the construction of a water passage at a position upstream of a jet propulsion unit that modulates the amount of water allowed to pass through the water passage.

2. Description of Related Art

Jet powered watercraft have become very popular in recent years for recreational use and for use as transportation in coastal communities. Jet-propelled watercraft offer high performance, improved acceleration and handling, and shallow-water operation. Accordingly, PWCs, which typically employ jet propulsion units, have become popular, especially in resort areas. As the use of PWCs has increased, a desire for improved performance, including greater operational efficiency, also has increased.

Typically, jet powered watercraft, such as PWCs, have a jet propulsion system mounted within the hull that ingests water and expels the water at a high velocity from the stern to propel the watercraft. For directional control, a nozzle is generally provided at the outlet of the jet pump to direct the flow of water in a desired direction. In the conventional PWC, turning is achieved by redirecting the flow of water from the nozzle.

In the typical arrangement for a jet propulsion unit, an engine output shaft is rotationally coupled to a drive shaft. The drive shaft extends into a water passage, which is defined by the hull of the watercraft partially below the water line. The water passage extends from a point forward of the rear of the watercraft to the rear of that watercraft. An impeller is attached to the drive shaft and is disposed within a pump housing portion of the water passage.

FIG. 7 shows a prior art jet propulsion system 600 disposed within the hull 612, of which only a portion is shown in broken lines. As shown, an inlet grate 642 is disposed at an inlet 686 to an intake ramp 688. The inlet grate 642 prevents large rocks, weeds, and other debris from entering the water intake ramp 688 and passing through the jet propulsion system 600. A pump support 650 or ride shoe forms the bottom portion 692 of the water intake ramp 688. The pump support 650 is coupled to the hull 612 within a tunnel 694 through fasteners and/or adhesives (not shown). The pump support 650 includes a main body portion 651 having a vertical attachment surface 652, a forward attachment location 654 that is secured to a ride plate 696, and a ramp portion 656. A passage (not shown) extends through the main body portion 651 of the pump support 650. The ramp portion 656 forms the bottom portion 692 of the water intake ramp 688.

From the water intake ramp 688, water enters into a jet pump 660. The jet pump 660 includes an impeller 670 and a stator 680. The impeller includes blades 672 that extend from a center portion 674 that is coupled to an engine by one or more shafts 698, such as a drive shaft and/or an impeller shaft. The rotation of the impeller 670 pressurizes the water, which then moves over the stator 680 that comprises a plurality of fixed stator blades 682. The role of the stator blades 682 is to decrease the rotational motion of the water so that almost all the energy given to the water is used for thrust, as opposed to just swirling the water. As shown, the impeller 670 and the stator 680 are both disposed within a jet propulsion unit housing 690 or pump housing. However, it is also known to position the stator 680 at a position outside of the housing 690 at a position downstream of the housing 690. The housing 690 includes a peripheral wall 691 which defines a passage through which water passes. A forward end 692 of the housing peripheral wall 691 is attached to the vertical attachment surface 654 or the pump support 650. The forward end 692 of the housing peripheral wall 691 defines the inlet into the housing 690.

Once the water leaves the jet pump 660, it goes through a venturi 610. In this prior art jet propulsion unit 600, the venturi 610 is disposed at the rearward end of the housing 690. Since the venturi's exit diameter is smaller than its entrance diameter, the water is accelerated further, thereby providing more thrust. As shown, the venturi 610 is integrated into the housing 690 and comprises the outlet from the housing 690.

A steering nozzle 602 is pivotally attached to the venturi 610 so as to pivot about a vertical axis 604. The steering nozzle 602 is operatively connected to a steering mechanism such as a steering handlebar (see, e.g., the steering handlebar 74 shown in FIG. 1). Rotation of the steering handlebar causes the steering nozzle 602 to pivot around the vertical axis 604, thereby directing the water discharge to result in a change in the steering direction of the watercraft.

A water passage 695, through which water passes from left to right, is illustrated in FIG. 7. Moving from left to right in this illustration, which is upstream to downstream, the water passage 695 is defined by the inlet 686, the water intake ramp 688, the pump support passage 653, the jet pump 660, the venturi 610 and the steering nozzle 602.

When the amount of water passing through the jet propulsion system 600 is not optimized, it is possible that cavitation may occur as a result of operation of the impeller 670. Cavitation occurs when an object, such as the impeller 670, moves through a fluid, such as water, at a sufficient speed to cause the water to form pockets of vapor. In other words, the impeller 670 can rotate so quickly that, at the tips of the impeller blades 672, a sufficiently low pressure region may be created that the water will flash into vapor, creating small vapor bubbles. When the vapor bubbles collapse, the shock of the collapse can degrade the impeller blades 672 (especially at the tips of the blades 672) by "eating away" at or pitting the blades 672. In addition, cavitation also has the undesired effect of producing noise and vibration that also degrade the operational efficiency of the jet propulsion system 608. In addition, noise and vibration increases the stress and wear and tear on the impeller 670 and components attached thereto.

In addition, when the watercraft is accelerating from a standing still or a low speed condition, the water drawn through the inlet 686 by the action of the pump 660 experiences a drop of static pressure, which is a condition that promotes cavitation. This undesirable drop of pressure can be minimized by increasing the size of the inlet 686, thus optimizing the system for the acceleration mode. Conversely, as the speed of the craft increases, the static pressure in the inlet builds up which leads to a condition that minimizes the formation of cavitation on bubbles in the flow, thus improving the propulsive efficiency of the pump 660. However, when the craft is traveling at high speed, the inlet pressure typically reaches an unnecessarily high level, this being a result of the relatively large inlet size chosen to accommodate the constraints of the low speed acceleration mode. Since a large inlet 686 cuts into the planing area of the hull thus increasing the drag, an inlet 686 optimized for acceleration from low speed will yield lower propulsive efficiency at high speed, while conversely an inlet 686 optimized for high speed will result in poor acceleration performance due to the occurrence of cavitation.

In view of the foregoing, a need has developed for a watercraft with a jet propulsion system that provides improved operational efficiency. Specifically, a need has developed for a watercraft design where the amount of water passing through the jet propulsion system can be modulated.

Also, in view of the foregoing, especially in view of the current trend to increase the operational power of boats and PWCs, a need has developed for a watercraft where cavitation is minimized or eliminated altogether.

These needs remain unaddressed by the prior art.

SUMMARY OF THE INVENTION

One aspect of embodiments of this invention is to provide a watercraft with a jet propulsion system that operates with improved operational efficiency.

Another aspect of the invention provides a watercraft with a jet propulsion system that minimizes or eliminates the occurrence of cavitation.

A further aspect of the present invention provides a structure disposed at the inlet of the water passage through which the amount of water passing through the jet propulsion system can be modulated.

In particular, this invention is directed to a watercraft with a hull having a bow and a stern. An engine is supported by the hull. A water passage is formed at least in part by the hull and has an inlet opening at a position forward of the stem of the hull, an interior, and an outlet at a position proximate to the stern of the hull. A jet propulsion unit is disposed in portion of the water passage. The jet propulsion unit is operatively connected to the engine. In one embodiment, a flexible barrier is disposed in the water passage upstream of the jet propulsion unit and a fluid is disposed on one side of the barrier such that the barrier separates the interior of the water passage from the fluid. The barrier is selectively movable with respect to the water passage.

In another embodiment, this invention is directed to a watercraft having a hull with a bow and a stem, an engine supported by the hull, a water passage having an inlet opening at a position forward of the stem of the hull and an outlet at a position proximate to the stem of the hull. A jet propulsion unit is disposed in a portion of the water passage and is operatively connected to the engine. A ride plate is disposed on the hull proximate to the inlet. At least a portion of the ride plate is operatively moveable through a predetermined range from at least a first position where the ride plate portion is disposed behind the inlet and a second position where the ride plate portion partially covers the inlet. The position of the ride plate determines the size of the inlet.

In a third embodiment, this invention is also directed to a watercraft having a hull with a bow and a stem, an engine supported by the hull, a primary water passage having an inlet opening at a position forward of the stern of the hull and an outlet at a position proximate to the stem of the hull. A jet propulsion unit is disposed in a portion of the primary water passage and is operatively connected to the engine. A secondary water passage longitudinally aligned with the primary water passage includes an inlet and an outlet through which water may flow from the secondary water passage into the primary water passage. A valve is disposed adjacent to the secondary water passage that modulates the flow of water from the secondary water passage into the primary water passage. The valve is movable from at least a first position and a second position. An actuator is operatively connected to the valve to move the valve between the first and second positions based on sensed conditions of the watercraft.

In a fourth embodiment, this invention is also directed to a watercraft having a hull with a bow and a stem, an engine supported by the hull, a primary water passage having an inlet opening at a position forward of the stern of the hull and an outlet at a position proximate to the stem of the hull. A jet propulsion unit is disposed in a portion of the primary water passage and is operatively connected to the engine. A secondary water passage and a tertiary water passage are each disposed laterally adjacent to the primary water passage. The secondary water passage includes a secondary inlet and a secondary outlet through which water may flow from the secondary water passage into the primary water passage, and the tertiary water passage includes a tertiary inlet and a tertiary outlet through which water may flow from the tertiary water passage into the primary water passage. A valve is disposed adjacent to each of the secondary water passage and the tertiary water passage that modulates the flow of water from the secondary water passage and the tertiary water passage into the primary water passage. Each valve is movable between at least an open position and a closed position. An actuator is connected to the valves to move the valves between the open position and the closed position based on sensed conditions of the watercraft. A controller is operatively connected to the actuator that controls movement of the valves to progressively open when the watercraft accelerates and to progressively close when the watercraft is operated at a high speed.

Preferably, the watercraft is a personal watercraft (PWC). The PWC can be a seated PWC or a stand-up PWC. Additionally, the watercraft could be a jet boat or a sport boat. The invention is not limited to watercraft and is applicable to various types of water-going vessels with jet propulsion units.

These and other aspects of this invention will become apparent from the disclosure that follows and the figures appended hereto.

BRIEF DESCRIPTION OF THE DRAWINGS

An understanding of the various embodiments of the invention may be gained by virtue of the following figures, of which like elements in various figures will have common reference numbers, and wherein.

DETAILED DESCRIPTION OF PREFERRED EMBODIMENT(S)

While this invention is specifically directed to a PWC and the jet propulsion system that powers such a watercraft, the invention is not intended to be limited solely to a PWC. As would be appreciated by those skilled in the art, the invention also encompasses other types of watercraft, including boats of any kind having water jet propulsion systems (e.g., sport boats, pontoon boats, yachts, etc.)

The general construction of a personal watercraft 10 in accordance with one embodiment of this invention is shown in FIGS. 1–5.

Figure 1:
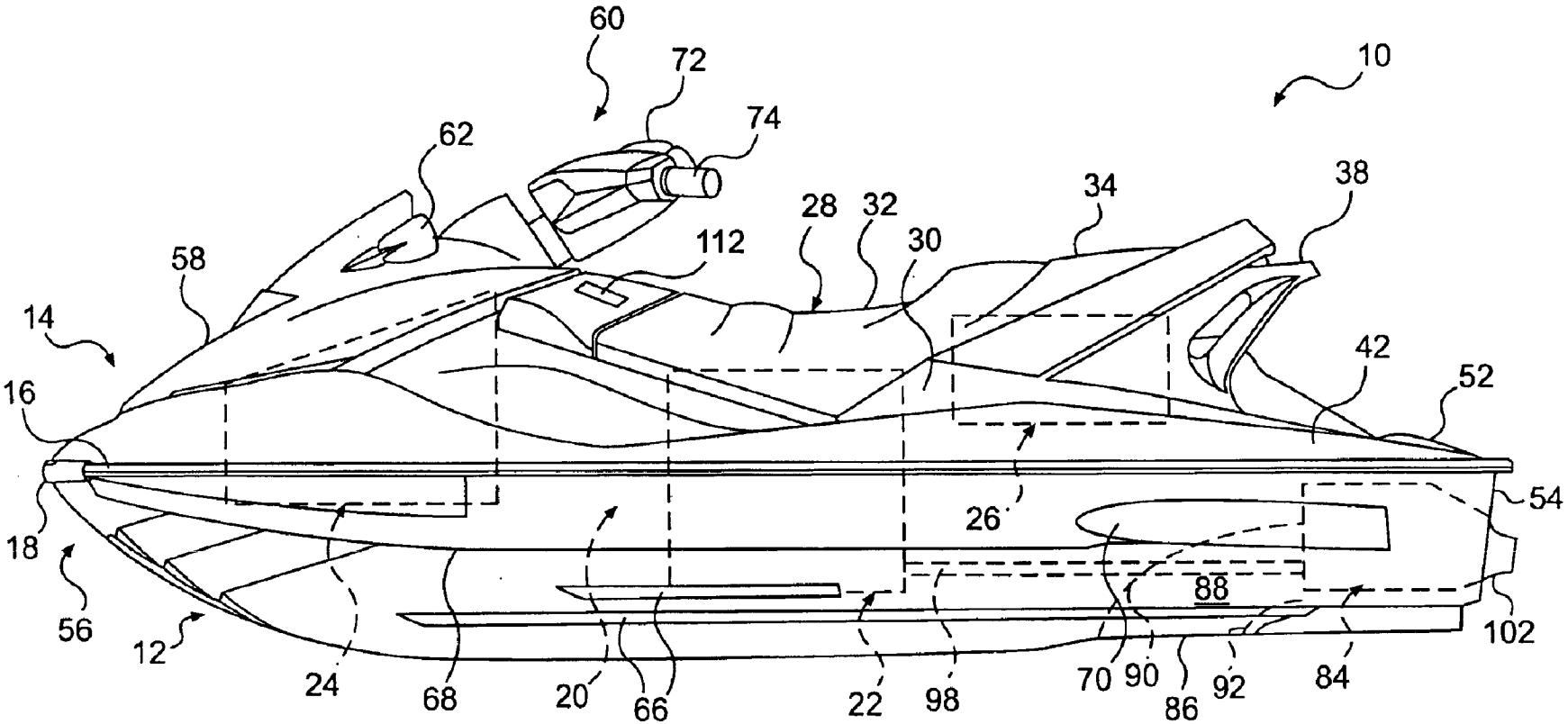
FIG. 1 illustrates a side view of a watercraft in accordance with an embodiment of the invention.

The watercraft 10 of FIG. 1 is made of two main parts, including a hull 12 and a deck 14. The hull 12 buoyantly supports the watercraft 10 in the water. The deck 14 is designed to accommodate one rider and, in some watercraft, one or more passengers. The hull 12 and deck 14 are joined together in a sealing relationship at a seam 16. Preferably, the seam 16 comprises a bond line formed by an adhesive. Of course, other known joining methods could be used to sealingly engage the parts together, including but not limited to thermal fusion, molding, or fasteners, such as rivets or screws. A bumper 18 generally covers the seam 16, which helps to prevent damage to the outer surface of the watercraft 10 when the watercraft 10 is docked, for example. The bumper 18 can extend around the bow, as shown, or around any portion or all of the seam 16.

The space between the hull 12 and the deck 14 forms a volume commonly referred to as the engine compartment 20 (shown in phantom). Shown schematically in FIG. 1, the engine compartment 20 accommodates an engine 22, as well as a muffler, tuning pipe, gas tank, electrical system (battery, electronic control unit, etc.), air box, storage bins 24, 26, and other elements required or desirable in the watercraft 10.

Figure 2:
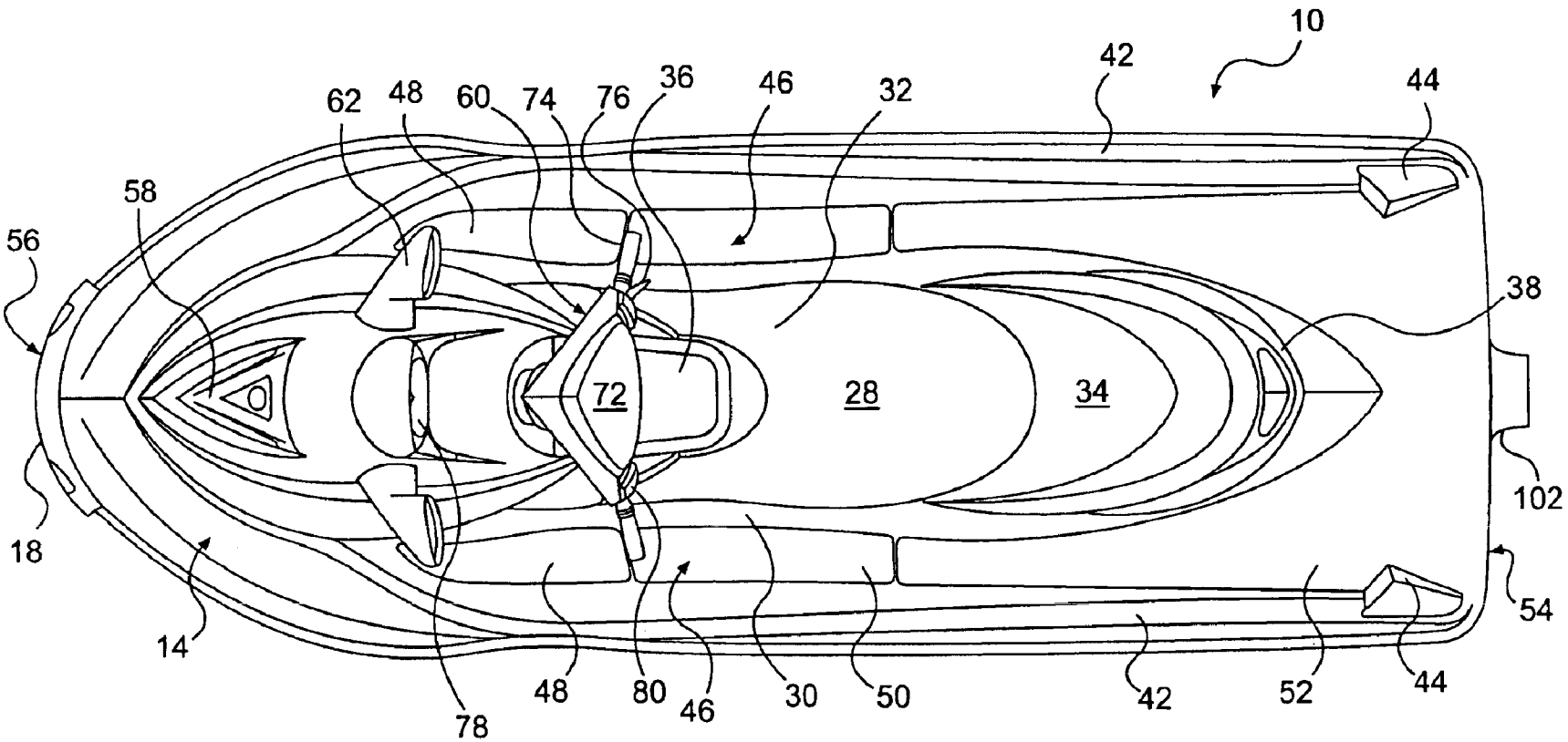
FIG. 2 is a top view of the watercraft of FIG. 1.

As seen in FIGS. 1 and 2, the deck 14 has a centrally positioned straddle-type seat 28 positioned on top of a pedestal 30 to accommodate a rider in a straddling position. The seat 28 may be sized to accommodate a single rider or sized for multiple riders. For example, as seen in FIG. 2, the seat 28 includes a first, front seat portion 32 and a rear, raised seat portion 34 that accommodates a passenger.

The seat 28 is preferably made as a single, cushioned or padded unit. However, the seat 28 may be constructed as several separate parts that interfit with one another. The first and second seat portions 32, 34 are preferably removably attached to the pedestal 30 by a hook and tongue assembly (not shown) at the front of each seat portion and by a latch assembly (not shown) at the rear of each seat portion, or by any other known attachment mechanism. Preferably, the seat portions 32, 34 can be individually, completely removed. One of the seat portions 32, 34 covers an engine access opening (in this case above engine 22) defined by a top portion of the pedestal 30 to provide access to the engine 22 (FIG. 1). The other seat portion (in this case portion 34) can cover a removable storage box 26 (FIG. 1). A "glove compartment" or small storage box 36 may also be provided in front of the seat 28.

Figure 4:
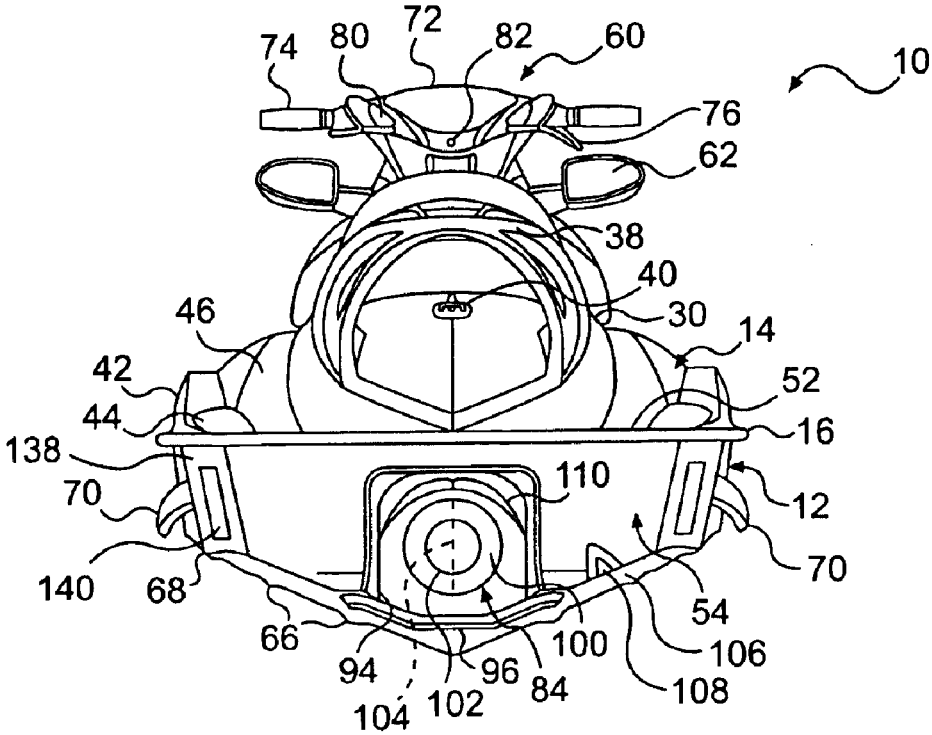
FIG. 4 is a rear view of the watercraft of FIG. 1.

As seen in FIG. 4, a grab handle 38 may be provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 (FIG. 4) is mounted on the pedestal 30. The tow hook 40 can be used for towing a skier or floatation device, such as an inflatable water toy.

As best seen in FIGS. 2 and 4 the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the rider's feet, and also provide buoyancy when turning the watercraft 10, since personal watercraft roll slightly when turning. Towards the rear of the watercraft 10, the gunnels 42 extend inwardly to act as heel rests 44. Heel rests 44 allow a passenger riding the watercraft 10 facing towards the rear to spot a water-skier, for example, to place his or her heels on the heel rests 44, thereby providing a more stable riding position. Heel rests 44 also could be formed as structures separate from the gunnels 42.

Located on both sides of the watercraft 10, between the pedestal 30 and the gunnels 42 are a pair of footrests 46. The footrests 46 are designed to accommodate a rider's feet in various riding positions. To this effect, the footrests 46 each have a forward portion 48 angled such that the front portion of the forward portion 48 (toward the bow of the watercraft 10) is higher, relative to a horizontal reference point, than the rear portion of the forward portion 48. The remaining portions of the footrests 46 are generally horizontal. Of course, any contour conducive to a comfortable position for the rider could be used. The footrests 46 may be covered by carpeting 50 made of a rubber-type material, for example, to provide additional comfort and traction for the feet of the rider.

A reboarding platform 52 is provided at the rear of the watercraft 10 on the deck 14 to allow the rider or a passenger to easily reboard the watercraft 10 from the water. Carpeting or some other suitable covering may cover the reboarding platform 52. A retractable ladder (not shown) may be affixed to the transom 54 to facilitate boarding the watercraft 10 from the water.

Figure 3:
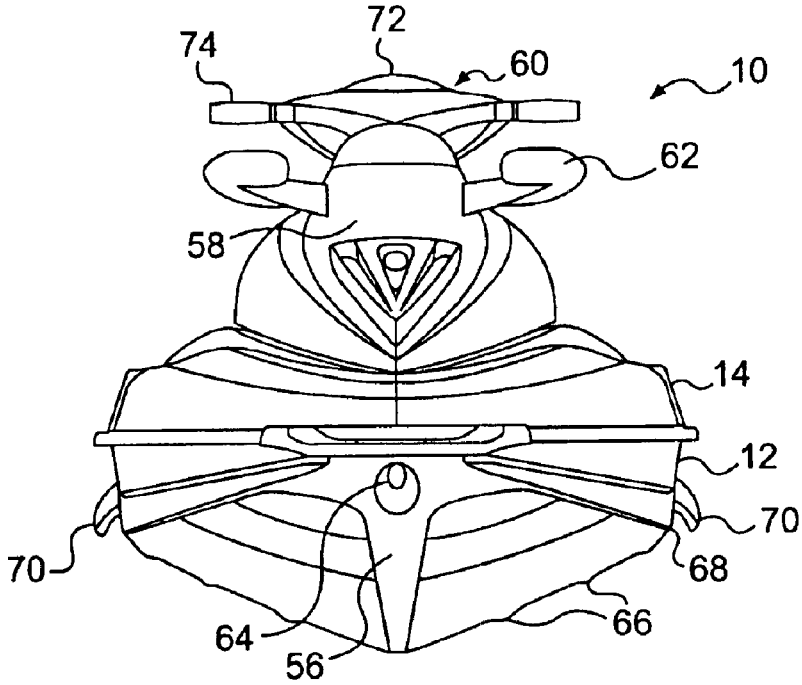
FIG. 3 is a front view of the watercraft of FIG. 1.

Referring to the bow 56, as seen in FIGS. 2 and 3, the watercraft 10 is provided with a hood 58 and a helm assembly 60 located forwardly of the seat 28. A hinge (not shown) is attached between a forward portion of the hood 58 and the deck 14 to allow hood 58 to be opened to provide access to the front storage bin 24 (FIG. 1). A latch (not shown) located at a rearward portion of the hood 58 locks the hood 58 into a closed position. When in the closed position, the hood 58 prevents water from entering the front storage bin 24. Rearview mirrors 62 are positioned on either side of the hood 58 to allow the rider to view objects behind the watercraft 10.

A hook 64 is located at the bow 56 of the watercraft 10. The hook 64 is used to moor the watercraft 10 to a dock when the watercraft is not in use. The hook 64 also functions as a convenient location to attach a winch when loading the watercraft 10 onto a trailer, for instance.

Figure 5:
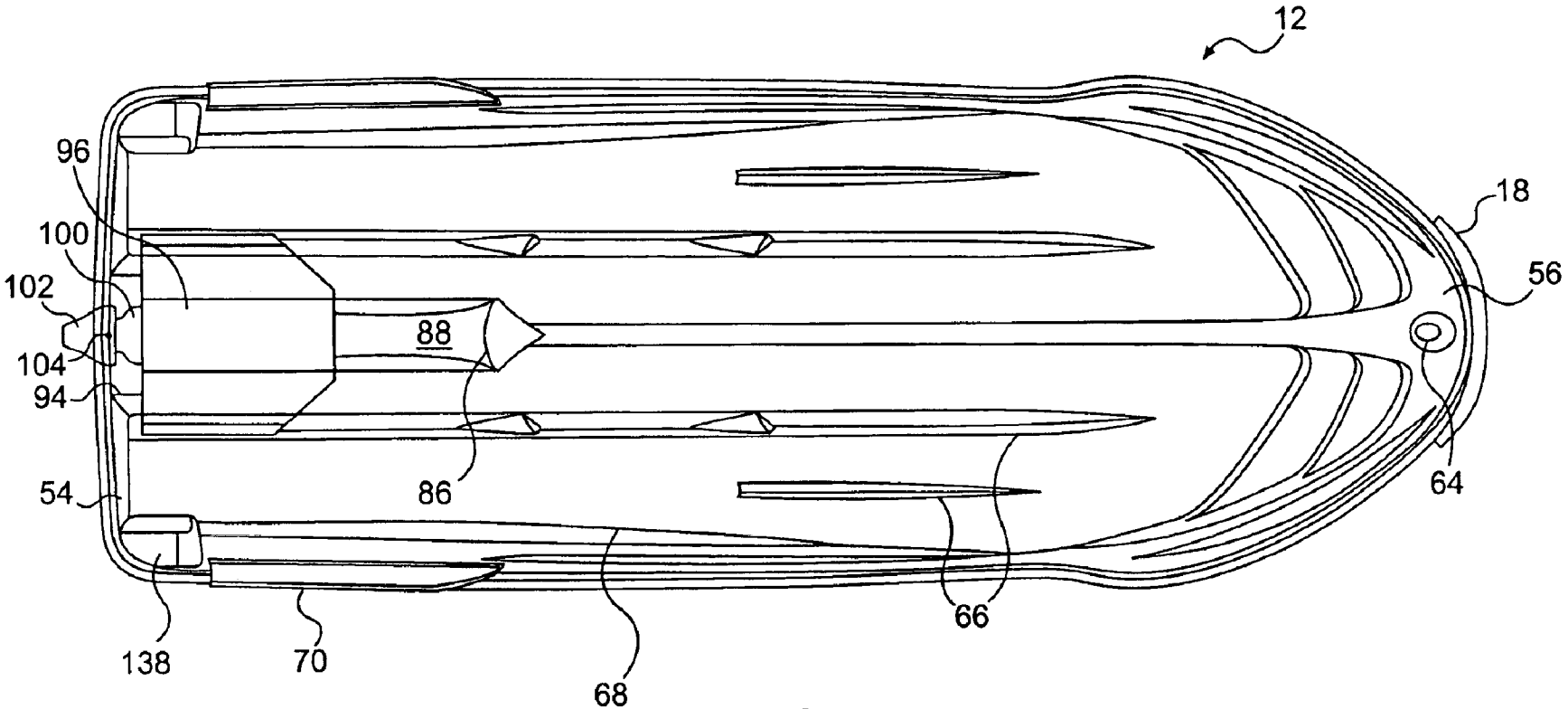
FIG. 5 is a bottom view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provides the watercraft 10 with its riding and handling characteristics.

Sponsons 70 are located on both sides of the hull 12 near the transom 54. The sponsons 70 preferably have an arcuate undersurface that gives the watercraft 10 both lift while in motion and improved turning characteristics. The sponsons 70 are preferably fixed to the surface of the hull 12 and can be attached to the hull 12 by fasteners or be molded integrally therewith. It is contemplated that the position of the sponson 70 may be adjustable with respect to the hull 12 to change the handling characteristics of the watercraft 10 and accommodate different riding conditions.

As best seen in FIGS. 3 and 4, the helm assembly 60 is positioned forwardly of the seat 28. The helm assembly 60 has a central helm portion 72 that may be padded and a pair of steering handles 74, also referred to as a handlebar. One of the steering handles 74 is preferably provided with a throttle lever 76, which allows the rider to control the speed of the watercraft 10.

As seen in FIG. 2, a display area or cluster 78 is located forwardly of the helm assembly 60. The display cluster 78 can be of any conventional display type, including LCD (liquid crystal displays), dials or LED (light emitting diodes). The central helm portion 72 may also have various buttons 80, which could alternatively be in the form of levers or switches, that allow the rider to modify the display data or mode (speed, engine rpm, time, etc.) on the display cluster 78. The central helm portion 72 also may be provided with one or more switches that change a condition of the watercraft 10 such as trim (the pitch of the watercraft) to modify the operational characteristics of the watercraft 10.

The helm assembly 60 may also be provided with a key receiving post 82, preferably located near a center of the central helm portion 72. The key receiving post 82 is adapted to receive a key (not shown), that starts the watercraft 10. As is known, the key is typically attaches to a safety lanyard (not shown), which clips onto the operator's life vest or clothing. It should be noted that the key receiving post 82 may be placed in any suitable location on the watercraft 10.

Returning to FIGS. 1 and 5, the watercraft 10 is generally propelled by a jet propulsion system 84, which includes a jet propulsion unit or jet pump. The jet propulsion system 84 is shown schematically in FIG. 1. As is known, the jet propulsion system 84 pressurizes water to create thrust. The water is first scooped from under the hull 12 through an inlet 86, which preferably has a grate (not shown in detail in FIGS. 1 and 5). Water flows from the inlet 86 through a water intake ramp 88. The top portion 90 of the water intake ramp 88 is formed by the hull 12. A ride shoe (not shown in detail in FIGS. 1 and 5) forms the bottom portion 92 of the water intake ramp 88. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

From the intake ramp 88, water enters the jet propulsion system 84. The jet propulsion system 84 is located in a formation in the hull 12 referred to as the tunnel 94 (see FIG. 8). The tunnel 94 is defined at the front, sides, and top by the hull 12 and is open at the transom 54. The bottom of the tunnel 94 is closed by the ride plate 96. The ride plate 96 creates a surface on which the watercraft 10 rides or planes at high speeds.

The jet propulsion system 84 includes a jet propulsion unit or jet pump 160 (seen in detail in FIG. 8, for example) made of two main parts: the impeller and the stator. The impeller is coupled to the engine 22 by one or more shafts 98, such as a drive shaft and/or an impeller shaft. Alternatively, the one or more shafts 98 could be operatively connected to one another through a gearbox or clutch. The scope of the invention should not be limited to this type of jet pump arrangement. Other jet pump arrangements are also possible; for example, the jet pump 160 could have two contra-rotating impellers.

The rotation of the impeller pressurizes the water, which then moves over the stator that is made of a plurality of fixed stator blades. The role of the stator blades is to decrease the rotational motion of the water so that almost all the energy given to the water is used for thrust, as opposed to swirling the water. Once the water leaves the jet pump 160, it goes through a venturi 100. Since the venturi's exit diameter is smaller than its entrance diameter, the water is accelerated further, thereby providing more thrust. A steering nozzle 102 is pivotally attached to the venturi 100 so as to pivot about a vertical axis 104. The steering nozzle 102 could also be supported at the exit of the tunnel 94 in other ways without a direct connection to the venturi 100. Alternatively, the nozzle 102 may be replaced by a rudder that re-directs the pressurized water for steering.

The steering nozzle 102 is operatively connected to the helm assembly 60 preferably via a push-pull cable (not shown) such that when the helm assembly 60 is turned, the steering nozzle 102 pivots about the vertical axis 104. This movement redirects the water coming from the venturi 100, so as to steer the watercraft 10 in the desired direction. Optionally, the steering nozzle 102 may be gimbaled to allow it to move around a second horizontal pivot axis (not shown). The up and down movement of the steering nozzle 102 around the horizontal pivot axis is known as "trim" and controls the pitch of the watercraft 10.

When the watercraft 10 is moving, its speed is measured by a speed sensor 106 (see FIG. 14) attached to the transom 54 of the watercraft 10. The speed sensor 106 has a paddle wheel 108 that is turned by the flow of water. In operation, as the watercraft 10 goes faster, the paddle wheel 108 also turns faster. An electronic control unit (not shown) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used, as would be readily recognized by one of ordinary skill in the art.

The watercraft 10 may be provided with the ability to move in a reverse direction. With this option, a reverse gate 110, seen in FIG. 4, is used. The reverse gate 110 is pivotally attached to the sidewalls of the tunnel 94 or directly on the venturi 100 or the steering nozzle 102. To cause the watercraft 102 move in a reverse direction, the rider pulls on a reverse handle 112 (FIG. 1) operatively connected to the reverse gate 110. The reverse gate 110 then pivots in front of the outlet of the steering nozzle 102 and redirects the water leaving the jet propulsion system 84 towards the front of the watercraft 10, thereby thrusting the watercraft 10 rearwardly. The reverse handle 112 can be located in any convenient position near the operator, for example adjacent the seat 28 as shown or on the helm 60.

Figure 6:
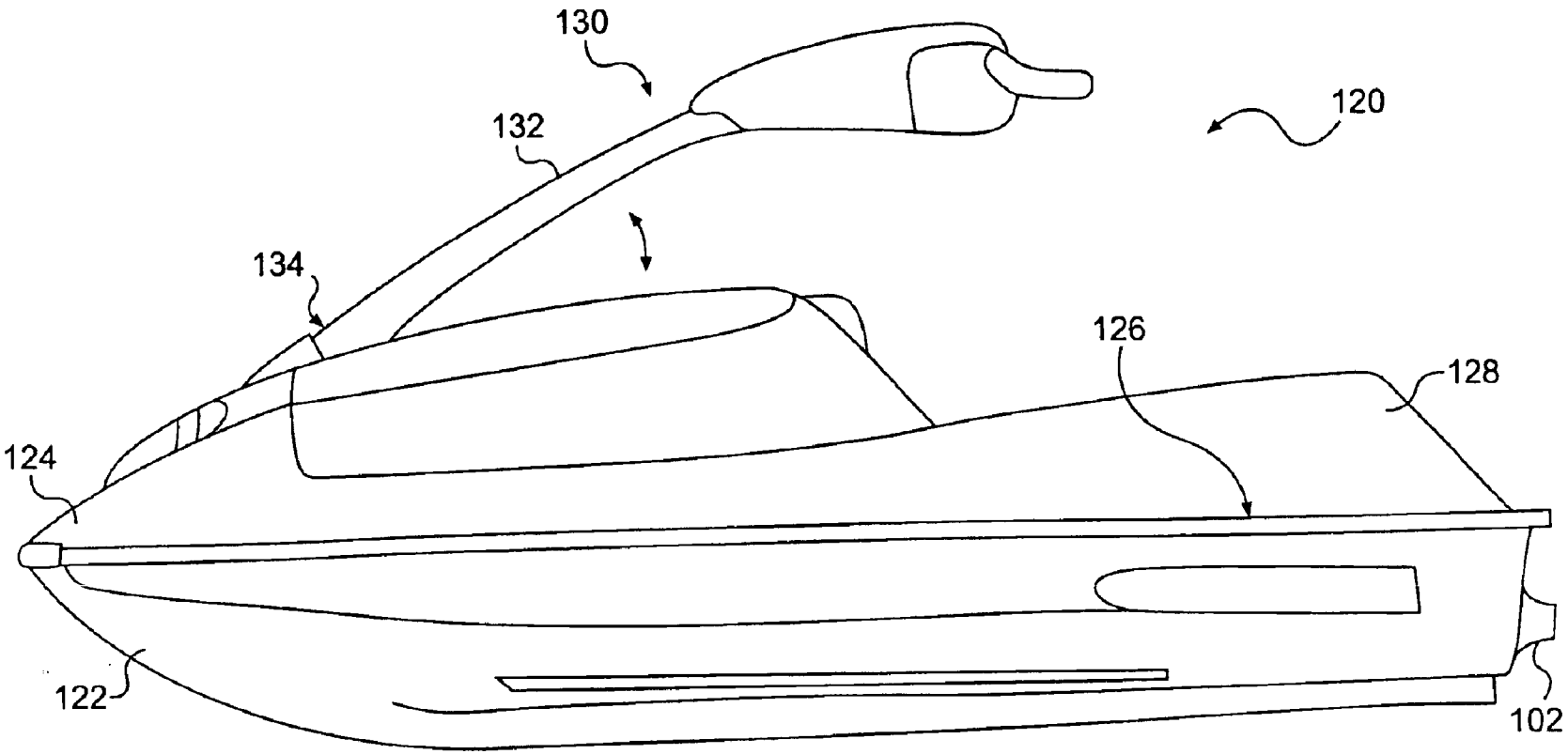
FIG. 6 illustrates an alternative stand-up type watercraft.
Figure 7:
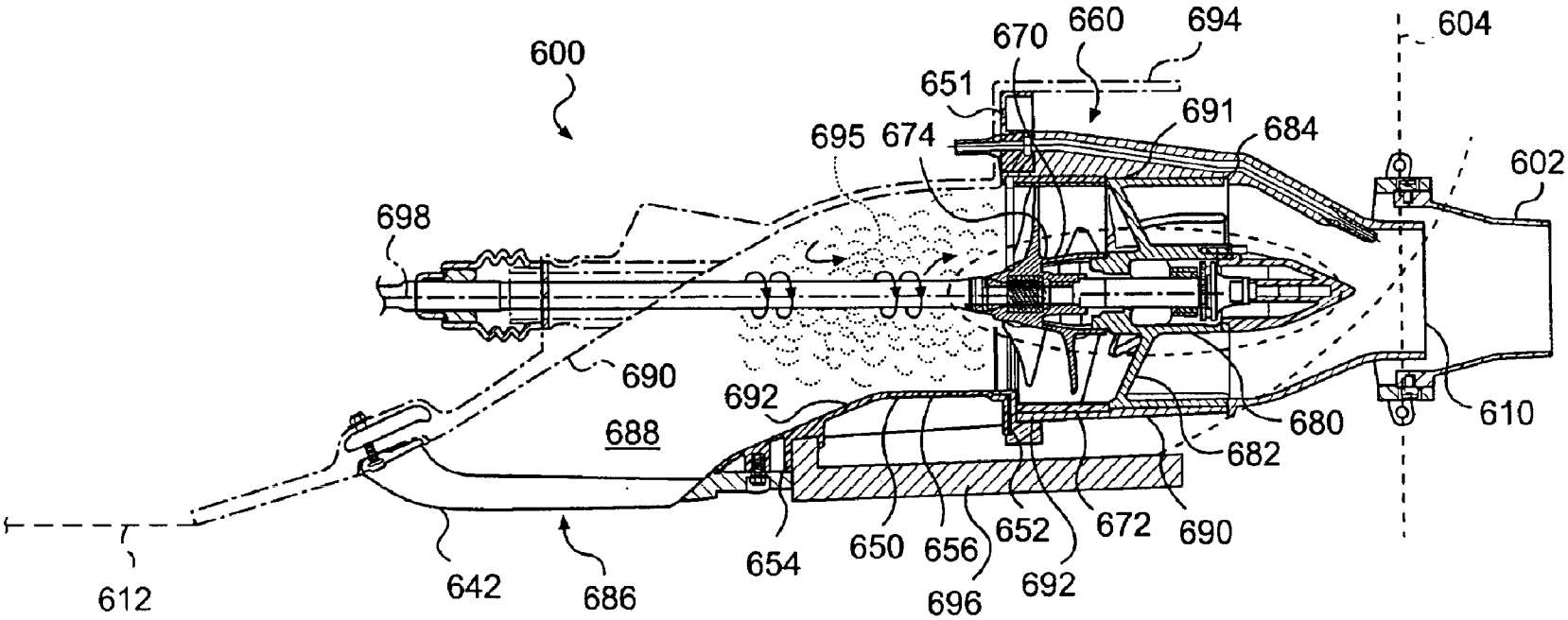
FIG. 7 PRIOR ART
FIG. 7 is a partial, cross-sectional side view of the stem of a watercraft showing a prior art jet propulsion system.

Alternatively, this invention can be embodied in a stand-up type personal watercraft 120, as seen in FIG. 6. Stand-up watercraft 120 are often used in racing competitions and are known for high performance characteristics. Typically, such stand-up watercraft 120 have a lower center of gravity and a more concave hull 122. The deck 124 may also have a lower profile. In this watercraft 120, the seat is replaced with a standing platform 126. The operator stands on the platform 126 between the gunnels 128 to operate the watercraft. The steering assembly 130 is configured as a pivoting handle pole 132 that tilts up from a pivot point 134 during operation, as shown in FIG. 6. At rest, the handle pole 132 folds downwardly against the deck 124 toward the standing platform 126. Otherwise, the components and operation of the watercraft 120 are similar to watercraft 10.

Figure 8:
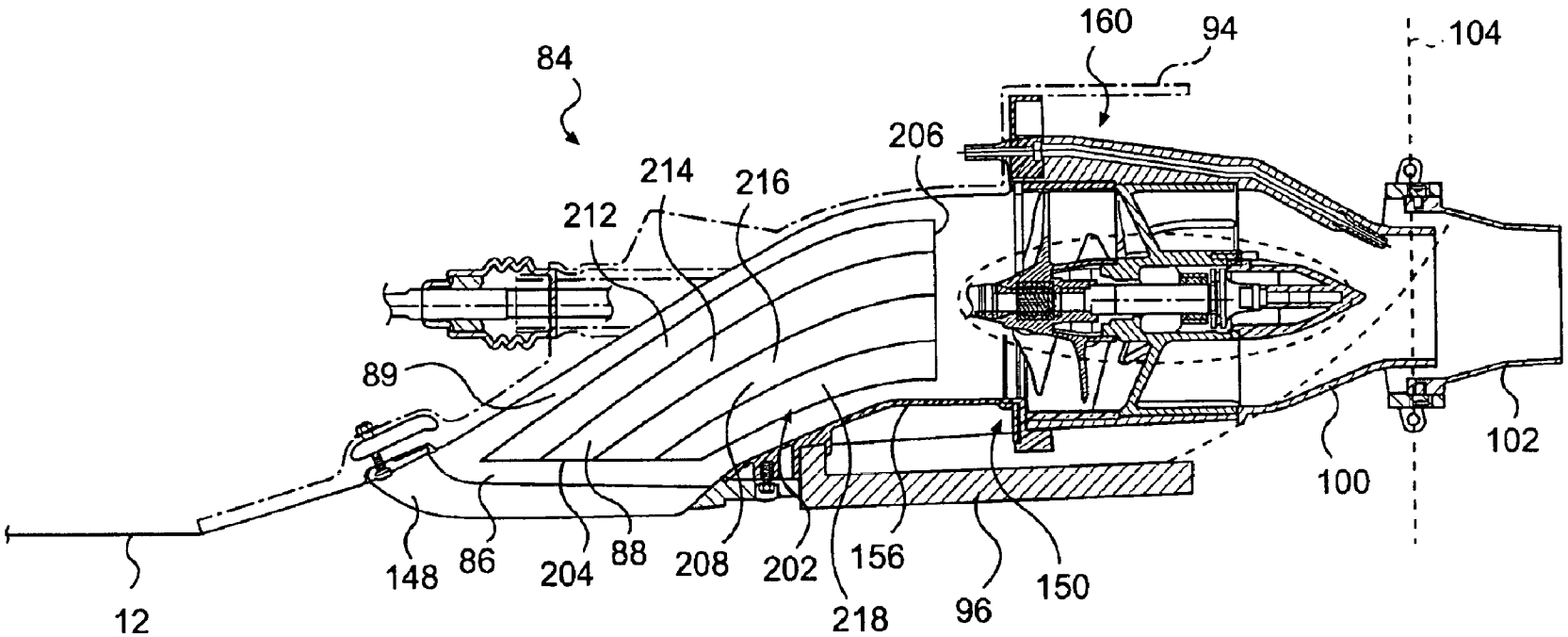
FIG. 8 is an enlarged, partial, cross-sectional side view of the stem of a watercraft showing a first embodiment of the jet propulsion system of the present invention.

FIG. 8 shows a first preferred embodiment of the jet propulsion system 84 of the present invention. As shown, the jet propulsion system 84 is disposed within the hull 12, of which only a portion is shown in broken lines to reveal the details of the jet propulsion system 84.

As is shown in FIG. 8, the jet propulsion system 84 includes an inlet 86 in the hull 12 that leads to a water intake ramp 88 in the tunnel 94. An inlet grate 148 can be provided at the inlet 86. A pump support 150 is secured within the tunnel 94. The water intake ramp 88 is defined by an interior wall 89 and a ramp portion 156 of the pump support 150. The jet pump 160 is secured within the tunnel 94 to the pump support 150.

According to one aspect of this invention, to control the volume of water entering the jet pump 160, an elongate bag 202 containing fluid is disposed within the water intake ramp 88. The bag 202 has a first end 204 disposed proximate to the inlet 86 and a second end 206 disposed proximate to the jet pump 160. Specifically, the bag 202 is attached to the starboard side of the water intake ramp interior wall 89, as seen in FIG. 8. The bag 202 in this embodiment of the invention comprises a set of four generally parallel bags 212, 214, 216, and 218, which are shown being attached together in a side by side arrangement. The four bags 212, 214, 216, and 218 could also be seen as four separate chambers of the elongate bag 202. Each of the four bags 212, 214, 216, and 218 preferably extends from the first end 204 to the second end 206 and contain fluid therein.

As would be appreciated by those skilled in the art, the bag 202 need not include only four bags 212, 214, 216, 218 to practice the present invention. To the contrary, any number of bags equal to or greater than one may be used to practice the present invention. In addition, the bags 212, 214, 216, 218 need not be fluidically separated from one another. Moreover, the bags 212, 214, 216, 218 need not be fluidically connected to one another. It is contemplated that, where a plurality of bags are used, one or more of the bags may be connected to others of the bags. In other words, using the bag 202 as an example, bags 212 and 216 may be fluidically connected while bags 214 and 218 are fluidically distinct from one another and from bags 212, 216.

The bag 202 forms a flexible barrier which separates water in the intake ramp 88 from the fluid in the bag 202. Specifically, the fluid within the bag 202 is disposed between water in the intake ramp 88 and a water intake ramp interior wall 89. Fluid within the bag 202 is allowed to flow along its length, toward the water passage inlet 86 and away from the water passage inlet 86. The flow of fluid within the bag 202 toward the inlet 86 constricts the inlet 86, and the flow of fluid within the bag 202 away from the inlet 86 dilates the inlet 86.

Figure 9:
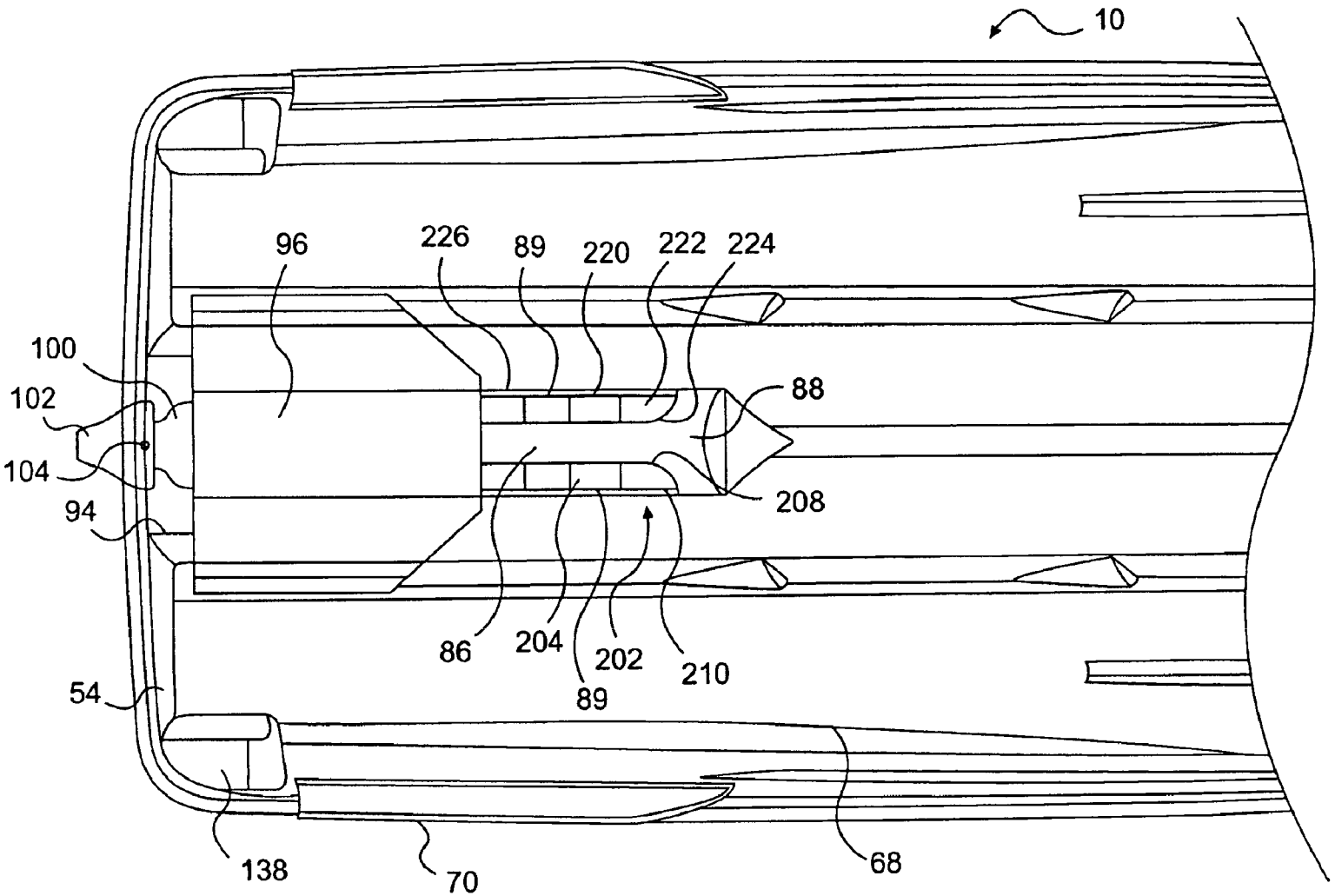
FIG. 9 is a bottom view of a portion of the jet propulsion system of FIG. 8, showing the watercraft in a first condition.

FIG. 9 shows the bottom side of the watercraft 10. In this figure, the inlet grate 148 has been removed so as not to conceal the details of the invention. As is shown in this figure, the bag 202, which is disposed on the starboard side of the water intake ramp 88, is accompanied by a second bag 220 disposed on the port side of the water intake ramp 88. It is contemplated that the bags 202, 220 can be used together or separately. The first end 204 of the bag 202 and a first end 222 of the bag 220 are shown in their respective positions within the water intake ramp 88. FIG. 9 further shows that the elongate bag 202 has an exterior surface 208 which is in contact with water in the water intake ramp 88, and an interior surface 210 which is attached to the interior wall 89 of the water intake ramp 88, through the use of fasteners (not shown) or adhesives (not shown). Similarly, bag 220 has an exterior surface 224 which is in contact with water in the water intake ramp 88, and an interior surface 226 which is attached to the interior wall 89 of the water intake ramp 88.

FIG. 9 shows a first possible condition of the bags 202, 220, where the fluid is evenly distributed.

Figure 10:
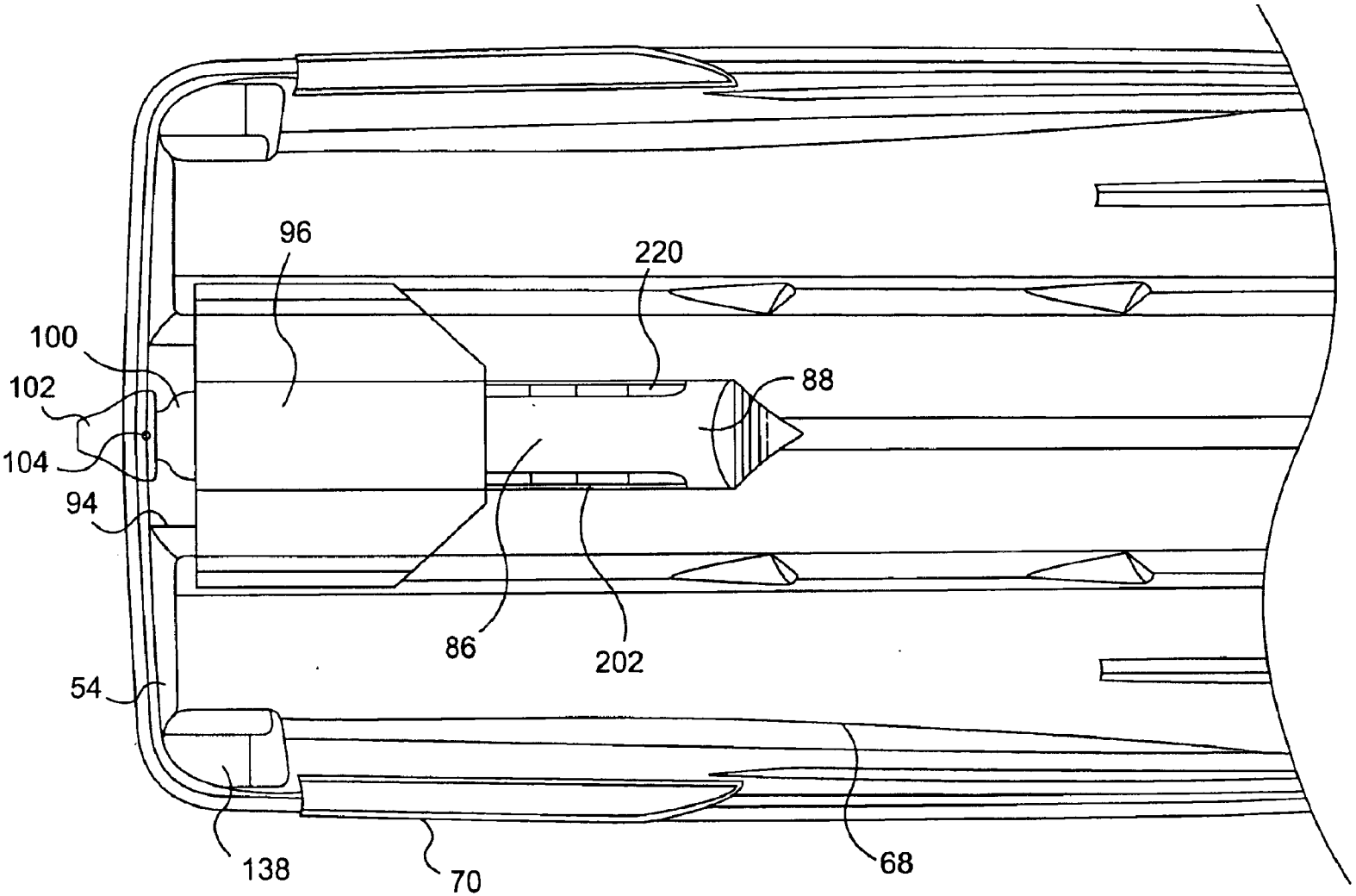
FIG. 10 is a bottom view of a portion of the jet propulsion system of FIG. 8, showing the watercraft in a second condition.

FIG. 10 shows a second possible condition of the bags 202, 220, where the fluid is being pushed rearwardly toward the jet pump 160.

The bags 202, 220 will assume whatever shape is optimal given the momentary dynamic and static forces acting thereon during operation of the watercraft 10.

Another aspect of this embodiment is providing a control mechanism to control the flow of fluid in the bags, either manually or automatically based on operating conditions of the watercraft 10. In that case, a reservoir could be provided to allow fluid to flow into or out of the bags. Such control could be hydraulic, pneumatic, manual, or electronic, among others.

As would be apparent to one skilled in the art, a variety of fluids (both liquids and gases) could be used within the bags 202, 220. Fluids such as gels having a substantial viscosity could also be used. Additionally, it would be apparent to one skilled in the art that a single elongate bag can be used or that elongate bags that do not have separated chambers can be used to practice the invention. In the event that bags, which include separated chambers, are used, it would be apparent to one skilled in the art that the separate chambers could be disposed at any desired orientation, such a horizontal.

In addition, while the foregoing description focuses on one embodiment having two bags 202, 220 secured to the interior walls 89 at the sides of the water intake ramp 88, any other position of the bag or bags within the water intake ramp 88 is considered to fall within the scope of the invention. In particular, bags could also be positioned at the top and bottom of the water intake ramp 88. In yet another alternative embodiment, a bag may partially or wholly surround the inlet 86 to the water intake ramp 88. As would be appreciated by those skilled in the art, the exact shape and positioning of one or more bags within the water intake ramp 88 is not critical to the practice of the present invention.

Figure 11:
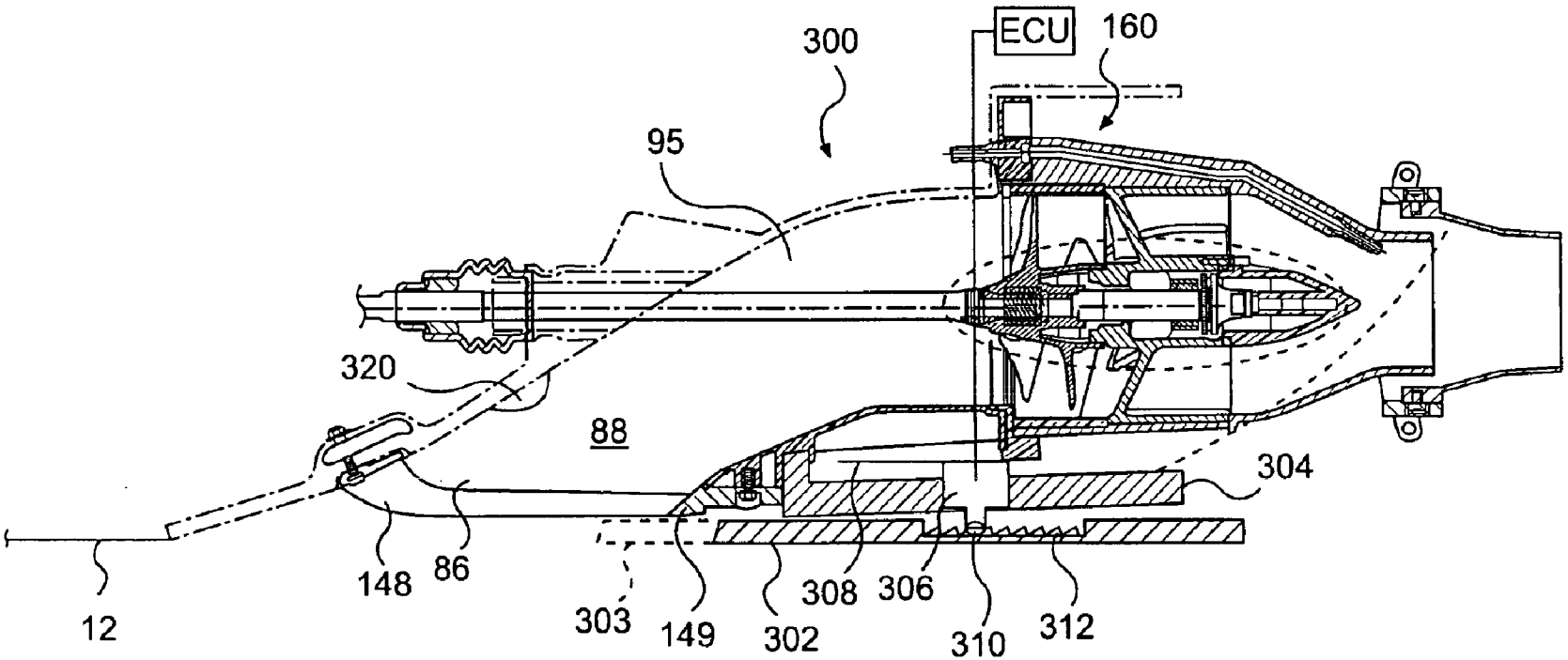
FIG. 11 is an enlarged, partial, cross-sectional side view of the stem of the watercraft showing another embodiment of the jet propulsion system of the present invention.

FIG. 11 shows another preferred embodiment of the jet propulsion system 300 of the present invention. As shown, the jet propulsion system 300 is disposed within the hull 12, of which only a portion is shown in broken lines to reveal the details of the jet propulsion system 300. An adjustable ride plate 302 is used to modulate the amount of water entering through the inlet 86 into the water intake ramp 88. The position of the ride plate 302 determines the size of inlet 86.

Specifically, in this embodiment of the present invention, the entire ride plate 302 preferably moves forward and rearward with respect to the hull 12. As was previously described, the ride plate 302 provides a rigid surface disposed for contact with a body of water while the watercraft 10 moves at high speeds. The ride plate 302 is movably mounted to a support plate 304 through the use of linear bearings (not shown) or other known structure that allows relative movement between two elements. The ride plate 302 has a forward end 303, which is shown in a position immediately behind a rearward portion 149 of the inlet grate 148.

An actuator 306 actuates movement of the ride plate 302 in relation to the support plate 304. The actuator 306 in this embodiment comprises an electric motor or other known electro-mechanic device such as a solenoid. In the embodiment shown in FIG. 11, the actuator 306 is mechanically connected to the ride plate through a rack 310 and pinion 312 gear system. As would be apparent to one skilled in the art, such a gear system is one of many ways that the actuator 306 could transmit movement to the ride plate 302. Other systems include an actuator comprising a linear stepper motor that has a linear output shaft that pushes or pulls the ride plate 302 into a desired position. Hydraulic or pneumatic controls responsive to manual input or automatically responsive to operating conditions of the watercraft could also be used.

The actuator 306 is preferably electrically connected to an ECU (shown schematically) or other known control unit through a known electrical connection such as wire 308. The ECU is disposed to receive a condition of the watercraft and to transmit a signal to the actuator 306 in response to the condition received by the ECU. The condition of the watercraft 10 can be acceleration, as measured in a known manner through the monitoring of the throttle valve (not shown), changes in the speed as measured by the speed sensor 106, or changes in the pressure within the water passage 95 as measured by a known pressure sensor 320. Upon the receipt of the signal at the actuator 306, the actuator changes the position of the ride plate 302, thus changing the size of the inlet 86.

As was previously shown in FIG. 4 with respect to the ride plate 96, the adjustable ride plate 302 also conforms to the bottom surface of the hull 12. Specifically, the portions of the ride plate 302 are preferably disposed in substantially the same plane as the portions of the hull 12 immediately proximate thereto. The various portions of the ride plate 302 remain substantially disposed within the same plane throughout the movement of the ride plate 302.

Figure 12:
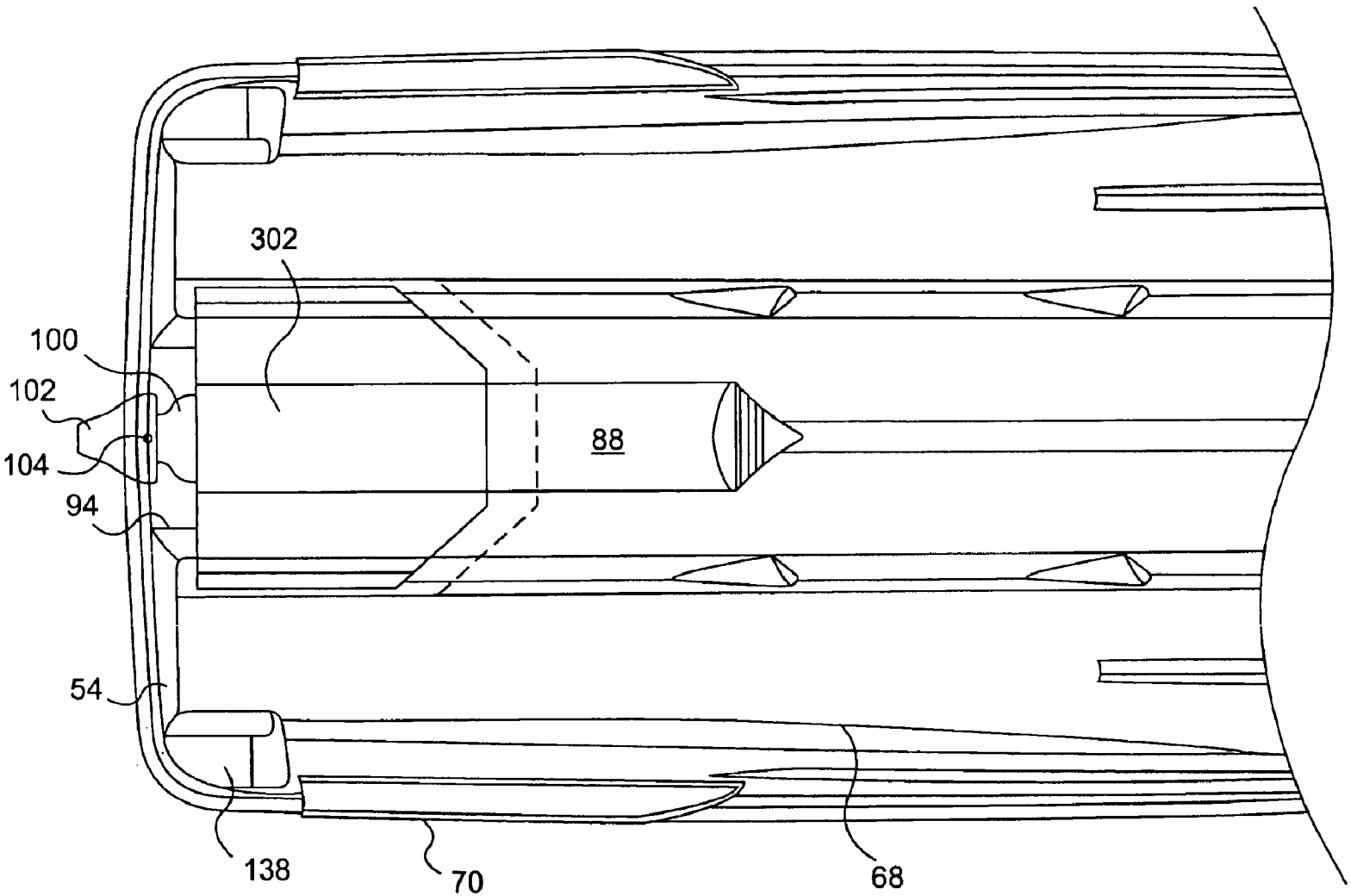
FIG. 12 is a bottom view of a portion of the jet propulsion system of FIG. 11.

The ride plate 302 is operatively moveable through a predetermined range from at least a first position where the ride plate 302 is entirely disposed behind the inlet 86 to a second position where the ride plate 302 partially covers the inlet 86. As is shown in FIG. 11, when the ride plate 302 is in the second position, the ride plate forward portion 303, which is shown in broken lines, is beneath and partially overlaps the inlet grate 148. FIG. 12 shows ride plate 302 in the first and second positions, with the second position shown in broken lines.

When the watercraft 10 is operated at a constant high speed, the ride plate 302 is maintained in the second position. In this second ride plate position, the ride plate 302 partially closes the inlet 86. The amount of water necessary for the jet propulsion system 300 to generate sufficient thrust to maintain the constant speed is provided by the inlet 86. However, when the watercraft 10 is accelerated, particularly from a low speed condition, the ride plate 302 is moved to the first position, thus reducing the water pressure drop in the inlet 86. These improved flow conditions allow the jet pump 160 to operate at a higher efficiency level, thus generating a greater amount of thrust. Once the watercraft 10 reaches a higher speed, and a higher water pressure in the inlet 86, the ride plate 302 is moved back into the second position.

It should be noted that the ride plate 302 is not expected to have only first and second positions (e.g., an open inlet 86 and a partially-closed inlet 86). To the contrary, it is contemplated that the position of the ride plate 302 may vary between the first and second positions depending on the conditions input into the ECU.

In addition, while the combination of an ECU and an actuator 306 is contemplated in one embodiment of the invention, an electromechanical operating system is not required to practice the invention as would be appreciated by those skilled in the art, other actuating systems may be employed.

For example, it is contemplated that the ride plate 302 may be biased into an opened position by a spring or other suitable biasing device. Movement of the ride plate 302 into a closed position (e.g., where the ride plate 302 partially covers the inlet 86) could then be accomplished fluidically. In other words, the increased pressure of the water in the water intake ramp 88 may be used to push the ride plate 302 in the closed position. With such a control system, when the watercraft 10 returns to a low-speed or accelerating condition, the biasing spring would then cause the ride plate to move into the partially-opened position.

Figure 13:
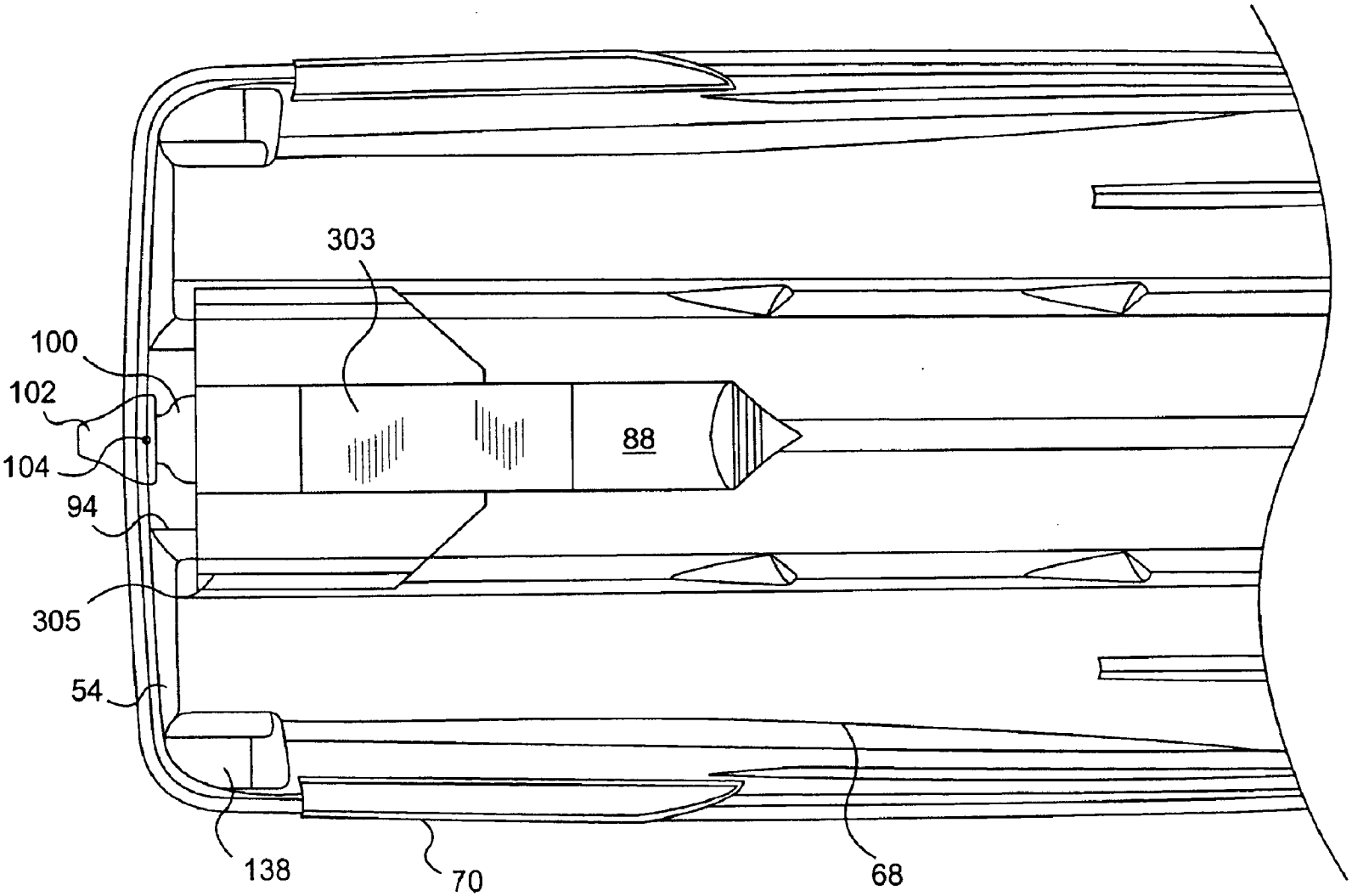
FIG. 13 is a bottom view of a portion of an alternative embodiment to the jet propulsion system illustrated in FIG. 11.

In yet another embodiment, as illustrated in FIG. 13, it is contemplated that only a portion 303 of the ride plate 305 will move to partially close the inlet opening 86 during a steady state operation. In this embodiment, the ride plate 305 remains fixed in its position on the hull 12 of the watercraft 10. As a result, the operational characteristics of the watercraft 10 will remain more constant, despite the changing position of the ride plate portion 303. As would be appreciated by those skilled in the art, any type of actuating device or system may be employed to move the ride plate portion 303 during operation of the watercraft 10, including those described above in connection with the ride plate 305.

In this regard, it is contemplated that a hydraulic piston could be positioned between the ride plate 305 and the movable ride plate portion 303 to move the ride plate portion 303 during operation of the watercraft 10. If a hydraulic piston is employed, the piston could be connected so that it utilizes the pressure of the water within the water intake ramp 88 for operation.

Figure 14:
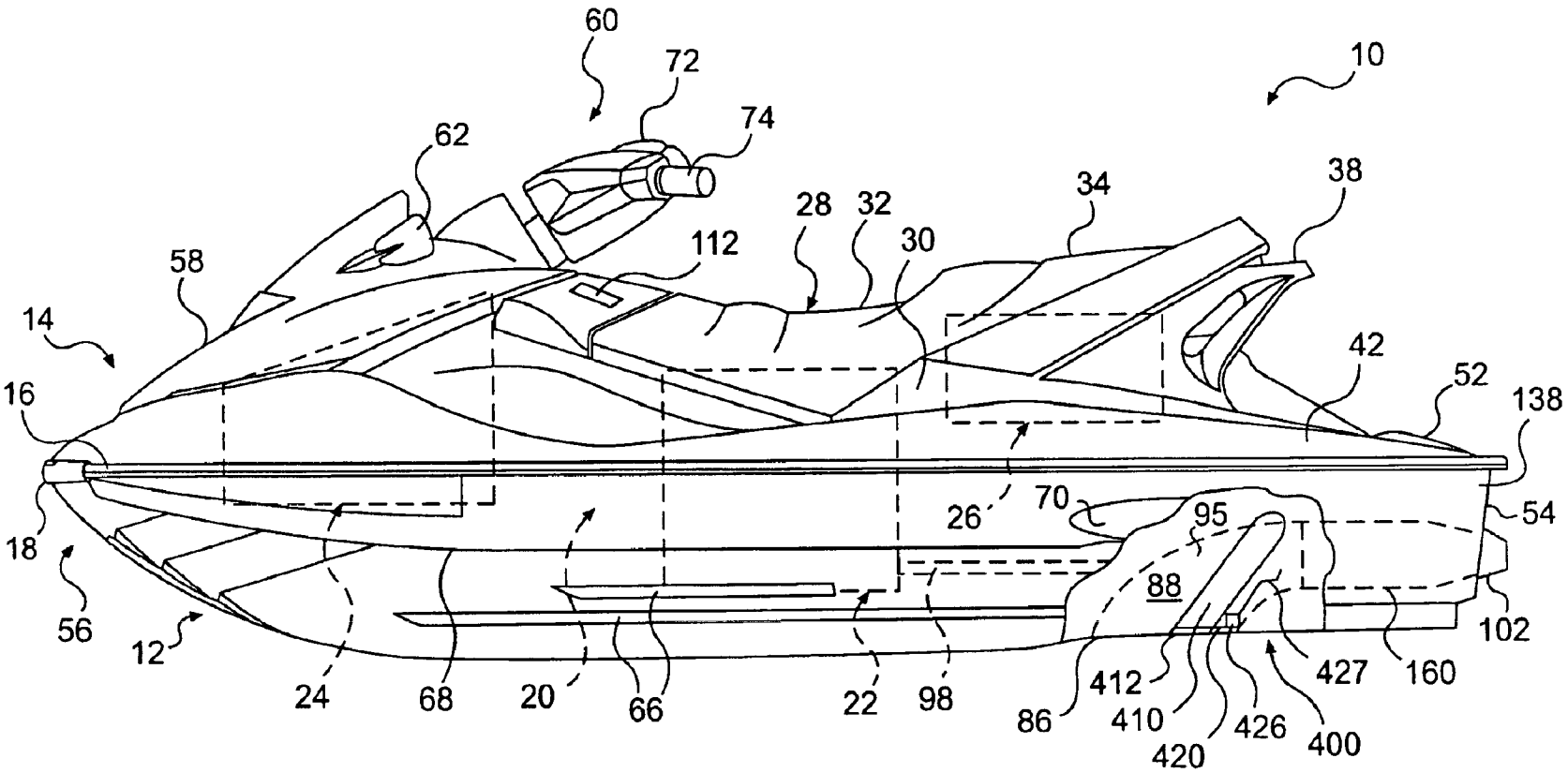
FIG. 14 is a side view illustration of a further embodiment of a watercraft of the present invention, with a portion of the hull broken away to show part of the jet propulsion system.

FIG. 14 shows another preferred embodiment of the jet propulsion system 400 of the present invention. As shown, the jet propulsion system 400 is disposed within the hull 12, a portion of which is broken away to reveal the details thereof. In this embodiment, the primary water passage 95 is accompanied by at least a secondary water passage 410 which has an inlet 412 that is independent of the primary water passage inlet 86. A valve 420 regulates the amount of water which may pass through the secondary water passage 410. The secondary water passage 410 includes an outlet (elements 416 and 417 shown in FIG. 15) through which water in the secondary water passage 410 is discharged into the primary water passage 95. Accordingly, the secondary water passage 410 is used to modulate the amount of water passing through the primary water passage 95.

Figure 15:
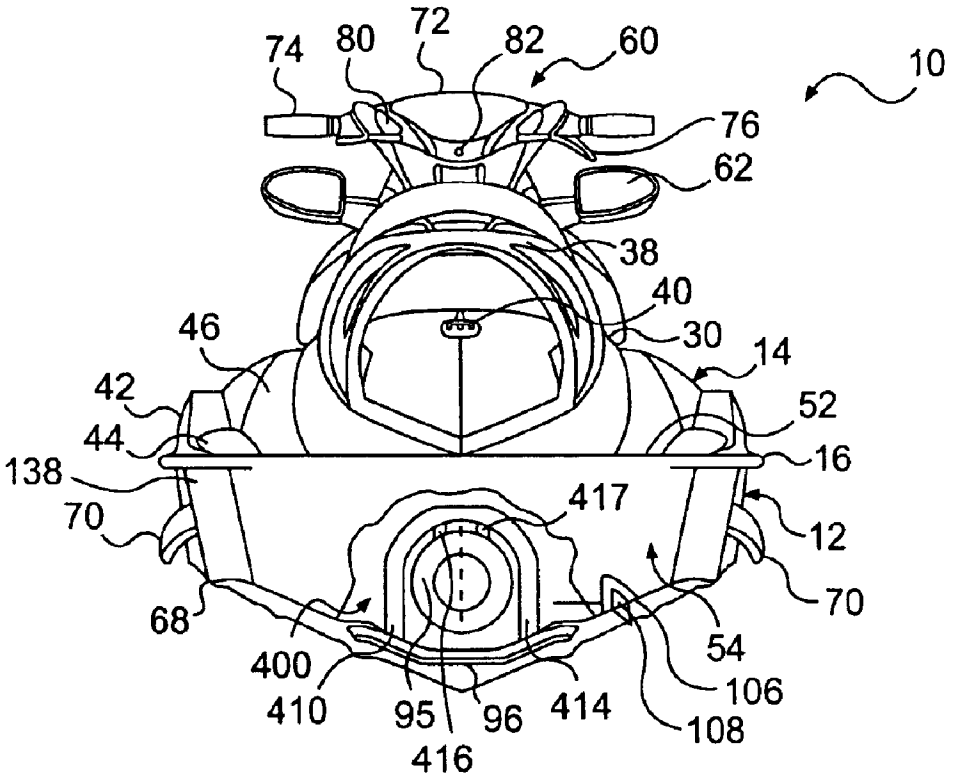
FIG. 15 is a rear view of the watercraft of FIG. 13, with a portion of the hull broken away to show part of the jet propulsion system.

FIG. 15 is a rear view with a portion of the transom 54 broken away to reveal the jet propulsion system 400. The reverse bucket 110 has also been removed from this figure. The secondary water passage 410 is preferably accompanied by a tertiary water passage 414, which, as shown in FIG. 14, are preferably connected. Specifically, the secondary and tertiary water passages 410, 414 are conduits in the form of an arch which straddle the primary water passage 95. Although secondary and tertiary water passages 410, 414 are shown, it would be apparent that only one of the two water passages 410, 414 may be used. Alternatively, a greater amount of water passages can also be used. It would also be apparent that the secondary and tertiary water passages 410, 414 can be a unitary conduit manufactured from metal, plastic or composite material, or an assembly of fittings.

Outlets 416, 417 are provided, which comprise passages through which water may flow from the secondary and tertiary water passages 410, 414 into the primary water passage 95. As would be appreciated by one skilled in the art, the outlets 416, 417 can be openings in the water passages 410, 414. Alternatively, the outlets 416, 417 can comprise fittings, valves, or other known devices or conduits through which liquids may be moved. The outlets 416, 417 are disposed at an upper portion of the primary water passage 95 at a position upstream of the impeller within the jet propulsion unit 160. The outlets 416, 417 are also preferably disposed rearwardly, toward the stern, relative to the secondary water passage inlet 412.

Figure 16:
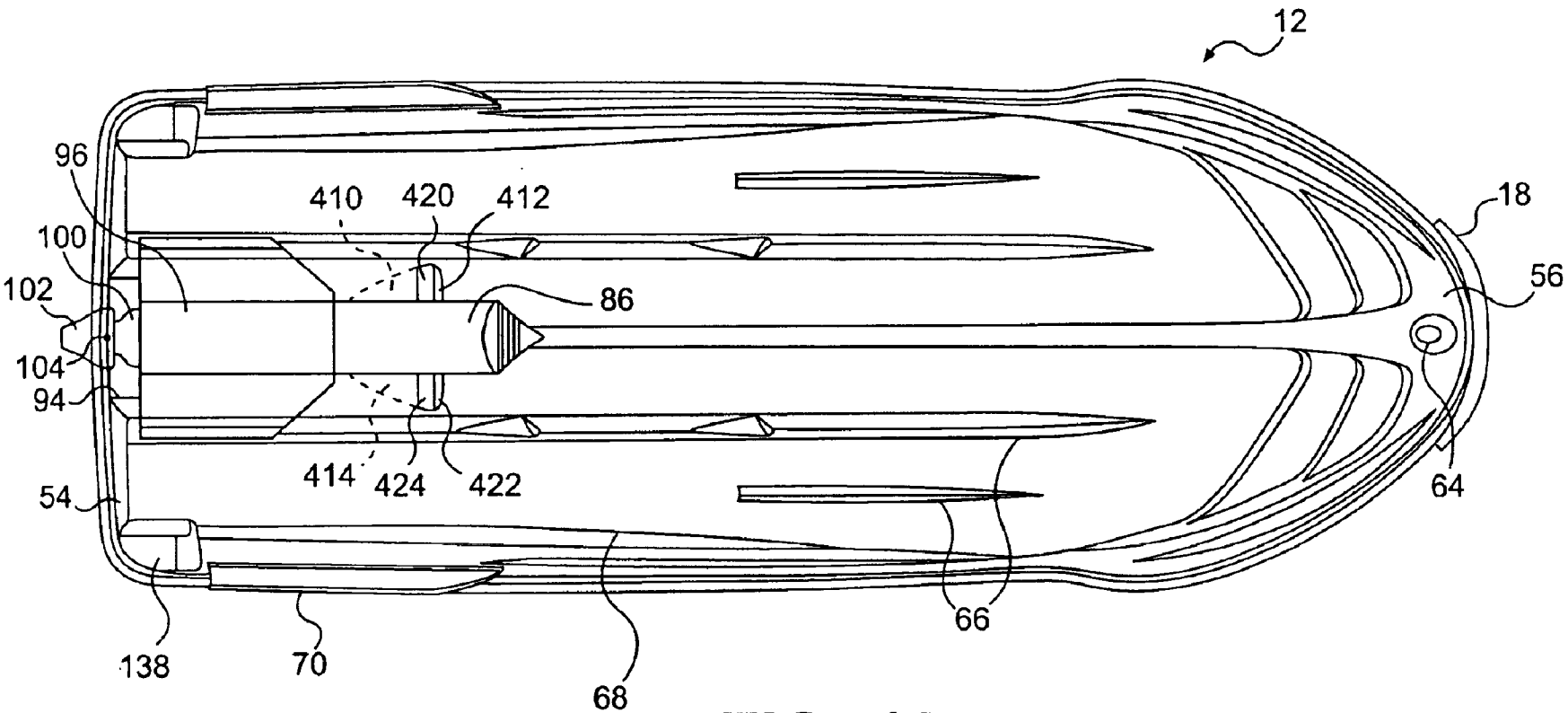
FIG. 16 is a bottom view of a portion of the jet propulsion system of FIG. 13.

As shown in FIG. 16, the tertiary water passage 414 has an inlet 422 which, like the secondary water passage inlet 412, is disposed laterally with respect to the primary water passage inlet 86. Preferably, the inlets 412, 422 are formed directly in the hull 12. The secondary water passage inlet 412 and tertiary water passage inlet 422 are both also preferably disposed immediately proximate to the primary water passage inlet 86. As is shown in FIGS. 14 and 16, the valve 420, which regulates the amount of water that may pass through the secondary water passage 410, is disposed at the secondary water passage inlet 412. A second valve 424, which regulates the amount of water that may pass through the tertiary water passage 420, is disposed at the tertiary water passage inlet 422. The valves 420, 424 modulate the flow of water from the secondary and tertiary water passages 410, 414 into the primary water passage 95. The valves 420, 424 are movable from at least a closed position where no water passes though the secondary and tertiary water passages 410, 414 to an open position where water passes though the secondary and tertiary water passages 410, 414.

An actuator 426 actuates movement of the valves 420, 424. The actuator 426 in this embodiment comprises an electric motor or other known electro-mechanic device such as a solenoid. The actuator 426 is mechanically connected to the valves 420, 424 through known mechanical elements such as levers or gears through which the actuator 426 can transmit movement to the valves 420, 424. Other systems include an actuator comprising a linear stepper motor that has a linear output shaft that pushes or pulls the valves 420, 424 into a desired position. Of course, other known actuators, such as hydraulic or pneumatic, may be used.

The actuator 426 is preferably electrically connected to an ECU (not shown) or other known control unit through a known electrical connection such as wire 427. The ECU is disposed to receive a condition of the watercraft 10 and to transmit a signal to the actuator 426 in response to the condition received by the ECU. The condition of the watercraft 10 can be acceleration, as measured in a known manner through the monitoring of the throttle valve (not shown), changes in the speed as measured by the speed sensor 106, or changes in the pressure within the water passage 95 as measured by a known pressure sensor 320 (shown previously in FIG. 11). Upon the receipt of the signal at the actuator 426, the actuator changes the position of the valves 420, 424, thus changing the size of the inlets 412, 422.

When the watercraft 10 is operated at a high speed, the valves 420, 424 are maintained in a closed or partially closed position. However, when the watercraft 10 is accelerated from a low speed or operates at a low speed, the valves 420, 424 are opened to minimize the drop of water pressure in the inlet 86. This minimizes the likeliness of cavitation to occur and allows the jet pump 160 to operate more efficiently. When the watercraft 10 reaches a high speed the valves 420, 424 are moved back into the closed or partially closed position.

Figure 17:
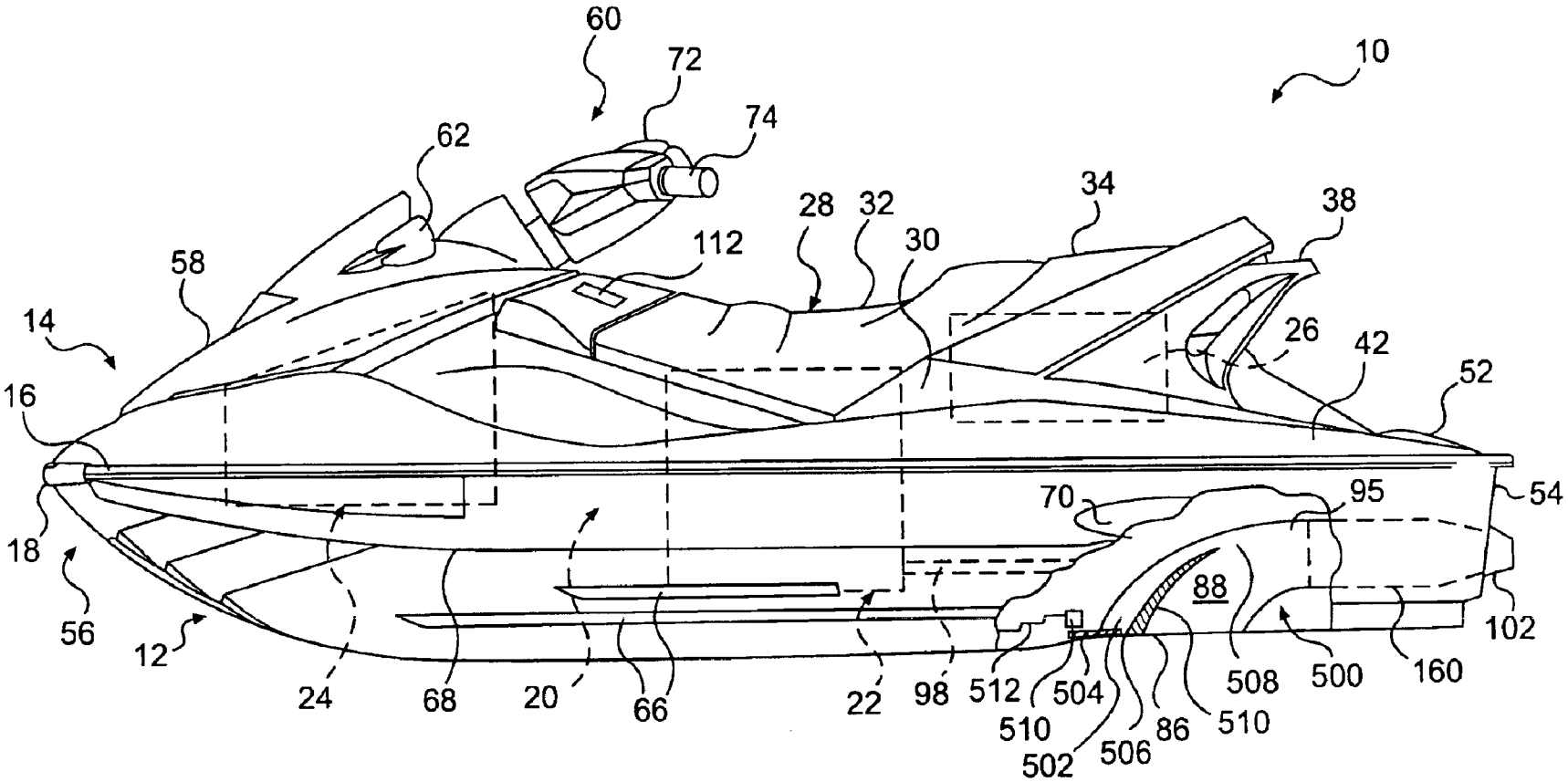
FIG. 17 is a side view illustration of another embodiment of the watercraft of the present invention, with a portion of the hull broken away to show part of the jet propulsion system.
Figure 18:
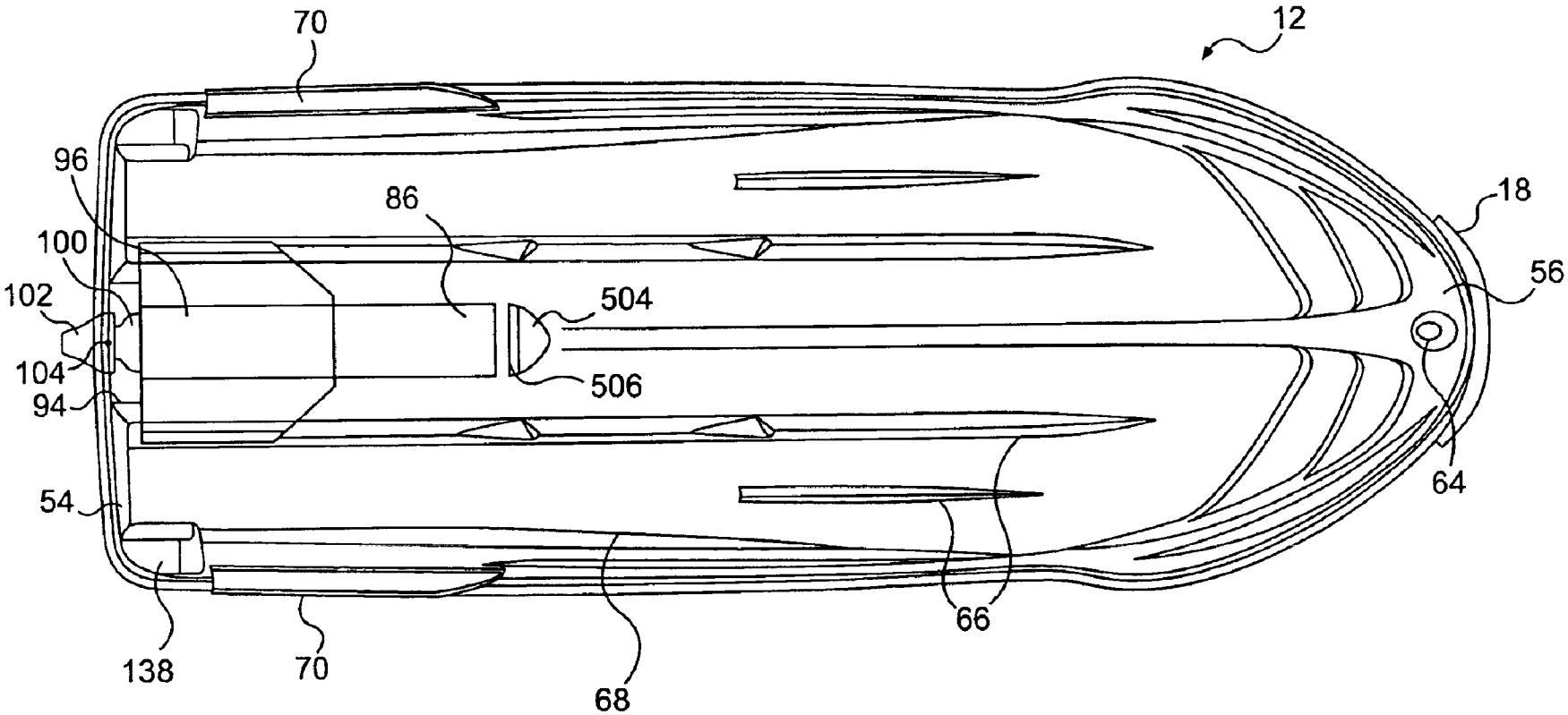
FIG. 18 is a bottom view of the watercraft illustrated in FIG. 17.

FIGS. 17 and 18 illustrate one further embodiment of the present invention, jet propulsion system 500. Jet propulsion system 500 is disposed within the hull, as shown in FIG. 17. Jet propulsion system 500 is similar to jet propulsion system 400, except that the secondary water passage 502 is positioned forwardly of the primary water passage 95. A valve 504 regulates the amount of water passing through the secondary water passage 502.

The secondary water passage 502 extends from a water inlet 506 to a connective opening 508 with the primary water passage 95. As shown in FIG. 17, the secondary water passage 502 is separated from the primary water passage 95 by a wall 510 positioned at a forward end of the inlet 86 in longitudinal alignment with the primary water passage 95.

As in the previous embodiment, the valve 504 is essentially a gate-like structure that can be slid or positioned over the inlet 506 into the secondary water passage 502. As the watercraft 10 accelerates from a low speed condition, the valve 504 is opened progressively further to increase the total inlet area to minimize the drop of water pressure in the inlet 86. When the watercraft 10 is moving at a high velocity, the valve 504 closes the inlet 506 into the secondary water passage 502 (partially or wholly) to reduce the amount drag created by the water inlet 506.

As in the previous embodiment, the valve 504 may be controlled by an actuator 510 connected to an ECU via a wire (or wing) 512. The actuator 510 may be electrically, electromagnetically, magnetically, hydraulically, or pneumatically controlled, among others. The location of the valve 504 is illustrated in FIG. 18.

As would be appreciated by those skilled in the art, the secondary and tertiary water passages 410, 414 could be used in combination with the secondary water passage 502 to further increase the total inlet cross-sectional area of the jet propulsion system, if desired.

In both of the jet propulsion systems 400, 500, the secondary and tertiary water passages 410, 414, 502 are angled upwardly and rearwardly as illustrated in FIGS. 14 and 17. The slanted arrangement of these water passages 410, 414, 502 assists in directing additional water through the jet propulsion systems 400, 500. The upward and rearward slant helps to scoop water up into water passages 410, 414, 502. As a result, the design of the water passages 410, 414, 502 assists in improving the operation of the jet propulsion systems 400, 500.

Figure 19:
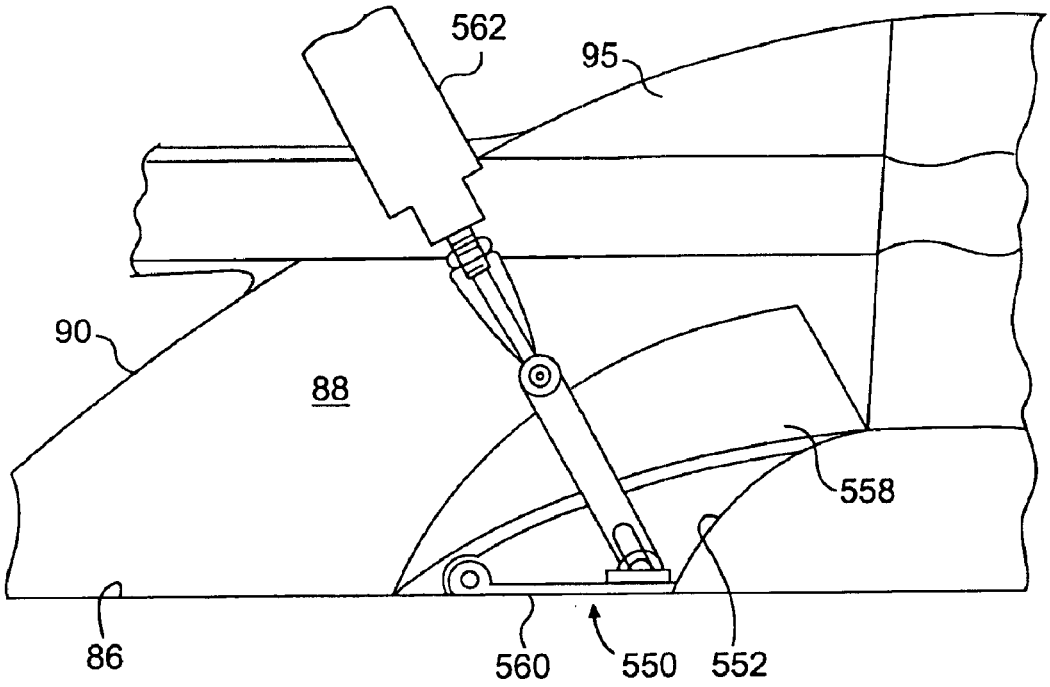
FIG. 19 is a schematic side view in cross section of another embodiment of the watercraft of the present invention.
Figure 20:
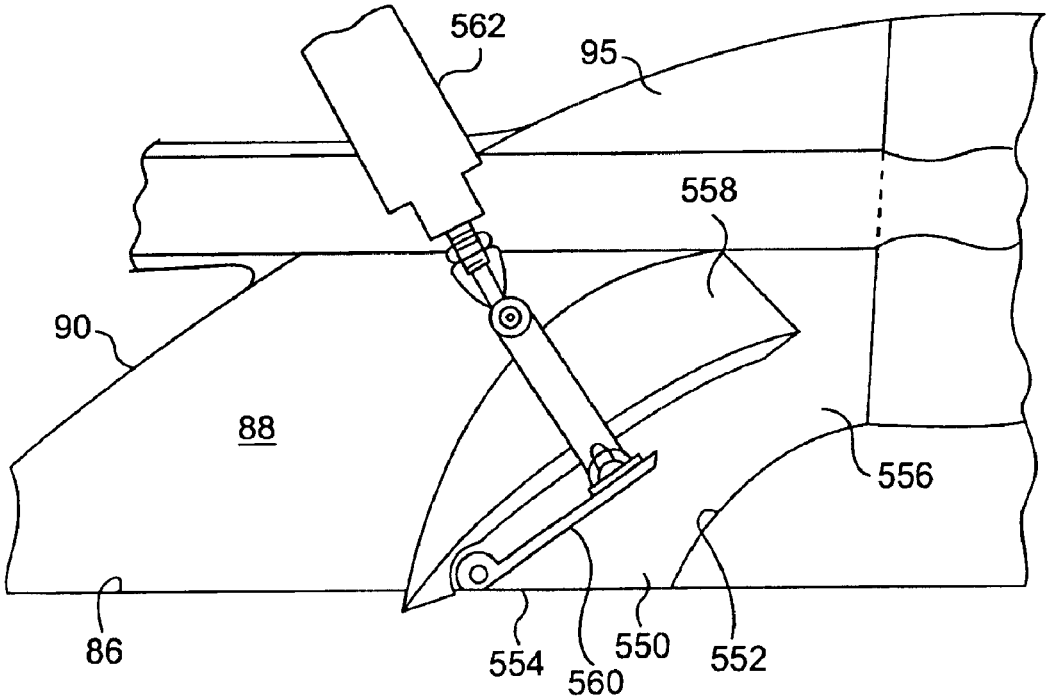
FIG. 20 is a schematic side view in cross section of the embodiment of FIG. 19 shown in an open position.

A similar embodiment is shown in FIGS. 19 and 20 in which the secondary water passage is angled upward and rearward. In this embodiment, the water intake ramp 88 leads to the primary water passage 95 and a secondary water passage 550 is provided in the rearward portion of the intake ramp 88 against a rear wall 552 of the ramp 88. The secondary water passage 550 is longitudinally aligned with the primary water passage 95 and has an inlet 554 and an outlet 556 that feeds into the primary water passage 95. A pivotal arcuate plate 558 is mounted across the intake ramp 88 to either side of the hull 12. The plate 558 is curved forming an inverted scoop. An actuating plate 560 is also pivotally mounted across the intake ramp 88 below the arcuate plate 558. An actuator 562 is connected to the actuating plate 560 on either or both sides in the hull 12 in a slot (not shown). The actuator 562 may be a hydraulic piston as shown or any electrical or mechanical actuating mechanism, including a gear or cable, for example.

In operation, the actuator 562 is connected to an ECU and may be controlled as described above in the same manner as in the other embodiments. As the watercraft 10 accelerates from a low speed condition, the actuating plate 560, which functions as a valve, is lifted progressively, which opens inlet 554 and then lifts arcuate plate 558, which also functions as a valve to control the volume of flow, to increase the total inlet area to minimize the drop of water pressure in the inlet 86. When the watercraft 10 is moving at a high velocity, the actuator 562 pushes the actuating plate 560 down to close the secondary water passage 550 (partially or wholly) to reduce the amount of drag created by water inlet 86.

The embodiments described herein are not mutually exclusive and can be used in combination. Additionally, as noted previously, this invention is not limited to PWC's. For example, the jet propulsion systems disclosed herein may also be useful in small boats or other floatation devices other than those defined as personal watercrafts. The adjustable inlets disclosed herein may be used in any type of jet propulsion device.

Although the above description contains specific examples of the present invention, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A watercraft comprising:

a hull having a bow and a stern;

an engine supported by the hull;

a water passage in the hull having an inlet at a position forward of the stern of the hull, an interior, and an outlet at a position proximate to the stern of the hull;

a jet propulsion unit disposed in a portion of the water passage, the jet propulsion unit being operatively connected to the engine;

a flexible barrier having a water contacting surface with a shape, the flexible barrier disposed in the water passage upstream of the jet propulsion unit; and a fluid disposed on one side of the barrier such that the barrier separates the interior of the water passage from the fluid, and wherein the barrier is movable with respect to the water passage such that water flowing in the passage changes the shape of the water contacting surface of the barrier.

2. The watercraft of claim 1, wherein the water passage is formed at least in part by the hull.

3. The watercraft of claim 1, wherein the jet propulsion unit comprises a pump housing and an impeller disposed within the pump housing.

4. The watercraft of claim 3, wherein the water passage upstream of the jet propulsion unit comprises a water intake ramp, the water intake ramp comprising at least an interior wall supported by the hull, the fluid being disposed between the interior of the water passage and the interior wall.

5. The watercraft of claim 4, wherein the flexible barrier comprises a flexible bag containing fluid that is attached to the interior wall of the water intake ramp.

6. The watercraft of claim 1, wherein the flexible barrier comprises at least one fluid containing elongate bag, the fluid containing elongate bag allowing fluid within to flow toward the water passage inlet and away from the water passage inlet.

7. The watercraft of claim 6, further comprising a plurality of generally parallel fluid containing elongate bags.

8. The watercraft of claim 7, wherein a first set of bags is placed on a starboard side of the water passage and a second set of bags is placed on a port side of the water passage.

9. A watercraft comprising:

a hull having a bow and a stern;

an engine supported by the hull;

a water passage having an inlet at a position forward of the stern of the hull and an outlet at a position proximate to the stern of the hull;

a jet propulsion unit disposed in a portion of the water passage, the jet propulsion unit being operatively connected to the engine; and a ride plate having a water contacting surface, the ride plate supported by the hull proximate to the inlet, the entirety of the water contacting surface of the ride plate being operatively moveable through a predetermined range from at least a first position where the ride plate portion is disposed behind the inlet and a second position where the ride plate portion partially covers the inlet, such that the position of the ride plate portion determines the size of the inlet.

10. The watercraft of claim 9, wherein the ride plate portion is the entire adjustable ride plate.

11. The watercraft of claim 9, wherein the jet propulsion unit comprises a pump housing and an impeller disposed within the pump housing.

12. The watercraft of claim 9, wherein the ride plate portion is disposed in substantially the same plane as the portion of the hull immediately proximate to the ride plate portion, and the ride plate portion remains substantially disposed within the same plane throughout its movement.

13. The watercraft of claim 9, further comprising an actuator operatively connected to the ride plate portion to actuate movement of the ride plate.

14. The watercraft of claim 13, further comprising an ECU in communication with the actuator, the ECU being disposed to receive a condition of the watercraft and to transmit a signal to the actuator in response to the condition received by the ECU.

15. The watercraft of claim 14, wherein:

the ECU communicates with the actuator through an electrical connection; and the ECU is disposed to receive a signal representative of the acceleration of the watercraft.

16. The watercraft of claim 13, wherein the actuator mechanism is electro-mechanical.

17. A watercraft comprising:

a hull having a bow and a stern;

an engine supported by the hull;

a primary water passage having an inlet at a position forward of the stern of the hull and an outlet at a position proximate to the stern of the hull;

a jet propulsion unit disposed in a portion of the primary water passage, the jet propulsion unit being operatively connected to the engine;

a secondary water passage longitudinally aligned with the primary water passage, the secondary water passage including a secondary inlet and a secondary outlet through which water may flow from the secondary water passage into the primary water passage;

a valve disposed adjacent to the secondary water passage that modulates the flow of water from the secondary water passage into the primary water passage, the valve being movable between at least a first position and a second position; and an actuator operatively connected to the valve to move the valve between the first and second positions based on sensed conditions of the watercraft, the actuator is operatively connected to a controller that controls movement of the valve to open toward the first position when the watercraft accelerates and to close toward the second position when the watercraft is operated at a high speed.

18. The watercraft of claim 17, wherein the jet propulsion unit comprises a pump housing and an impeller disposed within the pump housing.

19. The watercraft of claim 17, wherein the secondary water passage outlet is disposed rearwardly toward the stern relative to the secondary water passage inlet.

20. The watercraft of claim 17, wherein the secondary water passage is disposed forward of the primary water passage and extends rearwardly to connect with the primary water passage.

21. The watercraft of claim 17, wherein the secondary water passage is disposed rearward of the primary water passage and extends rearwardly to connect with the primary water passage.

22. The watercraft of claim 17, wherein the valve comprises a sliding gate.

23. The watercraft of claim 17, wherein the valve comprises a pivoting plate.

24. The watercraft of claim 23, wherein the valve comprises a pair of pivoting plates.

25. The watercraft of claim 17, wherein the controller controls the actuator based at least in part on a pressure in the primary water passage.

26. A watercraft comprising:

a hull having a bow and a stern;

an engine supported by the hull;

a primary water passage having an inlet at a position forward of the stern of the hull and an outlet at a position proximate to the stern of the hull;

a jet propulsion unit disposed in a portion of the primary water passage, the jet propulsion unit being operatively connected to the engine;

a secondary water passage and a tertiary water passage each disposed laterally adjacent to the primary water passage, the secondary water passage including a secondary inlet and a secondary outlet through which water may flow from the secondary water passage into the primary water passage, and the tertiary water passage including a tertiary inlet and a tertiary outlet through which water may flow from the tertiary water passage into the primary water passage;

a valve disposed adjacent to each of the secondary water passage and the tertiary water passage that modulates the flow of water from the secondary water passage and the tertiary water passage into the primary water passage, each valve being movable between at least an open position and a closed position;

an actuator connected to the valves to move the valves between the open position and the closed position based on sensed conditions of the watercraft; and a controller operatively connected to the actuator that controls movement of the valves to progressively open when the watercraft accelerates and to progressively close when the watercraft is operated at a high speed.

27. The watercraft of claim 26, wherein the secondary water passage outlet and the tertiary water passage outlet are disposed at an upper portion of the primary water passage.

28. The watercraft of claim 26, wherein the jet propulsion unit includes an impeller and the secondary water passage outlet and the tertiary water passage outlet are disposed upstream of the impeller.

29. The watercraft of claim 26, wherein the secondary and tertiary water passages are connected.

30. The watercraft of claim 26, wherein the secondary and tertiary water passages are in the form of an arch that straddles the primary water passage.

31. The watercraft of claim 26, wherein the actuator comprises a first actuator connected to the valve adjacent to the secondary water passage and a second actuator connected to the valve adjacent to the tertiary water passage.

* * * * *